US011602028B2

(12) United States Patent
Lee et al.

(10) Patent No.: US 11,602,028 B2
(45) Date of Patent: Mar. 7, 2023

(54) LED DEVICE AND LIGHTING DEVICE INCLUDING THE SAME

(71) Applicant: SAMSUNG ELECTRONICS CO., LTD., Suwon-si (KR)

(72) Inventors: Bongjin Lee, Hwaseong-si (KR); June Jang, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/407,826

(22) Filed: Aug. 20, 2021

(65) Prior Publication Data

US 2022/0167477 A1 May 26, 2022

(30) Foreign Application Priority Data

Nov. 23, 2020 (KR) ..... 10-2020-0157649

(51) Int. Cl.

| | |
|---|---|
| ***H05B 45/325*** | (2020.01) |
| ***H05B 45/10*** | (2020.01) |
| ***H05B 45/56*** | (2020.01) |
| ***H05B 45/48*** | (2020.01) |
| ***H05B 45/46*** | (2020.01) |
| ***H05B 45/20*** | (2020.01) |

(52) U.S. Cl.

CPC ..... *H05B 45/325* (2020.01); *H05B 45/10* (2020.01); *H05B 45/20* (2020.01); *H05B 45/46* (2020.01); *H05B 45/48* (2020.01); *H05B 45/56* (2020.01)

(58) Field of Classification Search

CPC ..... H05B 45/325; H05B 45/10; H05B 45/20; H05B 45/46; H05B 45/48; H05B 45/56

See application file for complete search history.

(56) References Cited

U.S. PATENT DOCUMENTS

| | | | |
|---|---|---|---|
| 6,372,608 | B1 | 4/2002 | Shimoda et al. |
| 6,645,830 | B2 | 11/2003 | Shimoda et al. |
| RE38,466 | E | 3/2004 | Inoue et al. |
| 6,818,465 | B2 | 11/2004 | Biwa et al. |
| 6,818,530 | B2 | 11/2004 | Shimoda et al. |
| 6,858,081 | B2 | 2/2005 | Biwa et al. |
| 6,967,353 | B2 | 11/2005 | Suzuki et al. |
| 7,002,182 | B2 | 2/2006 | Okuyama et al. |

(Continued)

FOREIGN PATENT DOCUMENTS

| | | | |
|---|---|---|---|
| JP | 2005-340559 | A | 12/2005 |
| KR | 10-2009-0014851 | A | 2/2009 |

(Continued)

*Primary Examiner* — Minh D A

(74) *Attorney, Agent, or Firm* — Sughrue Mion, PLLC

(57) ABSTRACT

A light emitting diode (LED) device is provided. The LED device a first LED string configured to emit light having a first color temperature; a second LED string connected to the first LED string in parallel, and configured to emit light having a second color temperature different from the first color temperature; a controller configured to generate a control signal based on a control command received from an external controller; a switching circuit configured to control brightness of any one or any combination of the first LED string and the second LED string based on the control signal; and a power supply configured to generate an internal power voltage for operation of the controller and the switching circuit.

19 Claims, 16 Drawing Sheets

(56) References Cited

U.S. PATENT DOCUMENTS

| | | | |
|---|---|---|---|
| 7,084,420 | B2 | 8/2006 | Kim et al. |
| 7,087,932 | B2 | 8/2006 | Okuyama et al. |
| 7,154,124 | B2 | 12/2006 | Han et al. |
| 7,208,725 | B2 | 4/2007 | Sherrer et al. |
| 7,288,758 | B2 | 10/2007 | Sherrer et al. |
| 7,319,044 | B2 | 1/2008 | Han et al. |
| 7,501,656 | B2 | 3/2009 | Han et al. |
| 7,709,857 | B2 | 5/2010 | Kim et al. |
| 7,759,140 | B2 | 6/2010 | Lee et al. |
| 7,781,727 | B2 | 8/2010 | Sherrer et al. |
| 7,790,482 | B2 | 9/2010 | Han et al. |
| 7,828,465 | B2 | 11/2010 | Roberge et al. |
| 7,940,350 | B2 | 5/2011 | Jeong |
| 7,959,312 | B2 | 6/2011 | Yoo et al. |
| 7,964,881 | B2 | 6/2011 | Choi et al. |
| 7,985,976 | B2 | 7/2011 | Choi et al. |
| 7,994,525 | B2 | 8/2011 | Lee et al. |
| 8,008,683 | B2 | 8/2011 | Choi et al. |
| 8,013,352 | B2 | 9/2011 | Lee et al. |
| 8,018,151 | B2 | 9/2011 | Chung et al. |
| 8,049,161 | B2 | 11/2011 | Sherrer et al. |
| 8,129,711 | B2 | 3/2012 | Kang et al. |
| 8,179,938 | B2 | 5/2012 | Kim |
| 8,263,987 | B2 | 9/2012 | Choi et al. |
| 8,324,646 | B2 | 12/2012 | Lee et al. |
| 8,399,944 | B2 | 3/2013 | Kwak et al. |
| 8,432,511 | B2 | 4/2013 | Jeong |
| 8,459,832 | B2 | 6/2013 | Kim |
| 8,502,242 | B2 | 8/2013 | Kim |
| 8,536,604 | B2 | 9/2013 | Kwak et al. |
| 8,569,969 | B2 | 10/2013 | Moss |
| 8,735,931 | B2 | 5/2014 | Han et al. |
| 8,766,295 | B2 | 7/2014 | Kim |
| 10,448,471 | B1 * | 10/2019 | Chowdhury ..... H05B 45/46 |
| 2019/0306949 | A1 * | 10/2019 | Murray ..... H05B 45/37 |
| 2020/0146119 | A1 | 5/2020 | Li |
| 2020/0367335 | A1 * | 11/2020 | Serra ..... H05B 45/325 |

FOREIGN PATENT DOCUMENTS

| | | | |
|---|---|---|---|
| KR | 10-2012-0011572 | A | 2/2012 |
| KR | 10-2013-0047919 | A | 5/2013 |
| KR | 10-2013-0103985 | A | 9/2013 |
| KR | 10-2017-0012610 | A | 2/2017 |
| WO | 2012/015161 | A1 | 2/2012 |

* cited by examiner

LED DEVICE AND LIGHTING DEVICE INCLUDING THE SAME

CROSS-REFERENCE TO RELATED APPLICATION(S)

This application claims priority from Korean Patent Application No. 10-2020-0157649 filed on Nov. 23, 2020 in the Korean Intellectual Property Office, the disclosure of which is incorporated herein by reference in its entirety.

BACKGROUND

Methods, apparatuses and systems consistent with example embodiments relate to an LED device and a lighting device including the same.

Light Emitting Diodes (LEDs) have advantages such as low power consumption and a relatively long lifespan, and are rapidly replacing fluorescent and incandescent lamps. Recently, various types of lighting devices employing LEDs as light sources have been developed and sold, and research into lighting devices having various functions in addition to simple lighting functions has also been actively carried out. For example, a function capable of controlling a color temperature and/or brightness of light or monitoring an operating state of LEDs mounted as a light source may be applied to a lighting device.

SUMMARY

One or more example embodiments provide an LED device in which various functions may be provided while significantly reducing replacement and/or upgrade of components included in a lighting device, and a lighting device including the same.

According to an aspect of an example embodiment, an LED device includes: a first LED string configured to emit light having a first color temperature; a second LED string connected to the first LED string in parallel, and configured to emit light having a second color temperature different from the first color temperature; a controller configured to generate a control signal based on a control command received from an external controller; a switching circuit configured to control brightness of any one or any combination of the first LED string and the second LED string based on the control signal; and a power supply configured to generate an internal power voltage for operation of the controller and the switching circuit.

According to an aspect of an example embodiment, a lighting device includes: an LED driver configured to generate driving power using alternating current (AC) power, and output the driving power through a first driving node and a second driving node; a plurality of LED strings including a first LED string connected between the first driving node and a first LED output node, and a second LED string connected between the first driving node and a second LED output node, the first LED string, being configured to emit light having a first color temperature and the second LED string being configured to emit light having a second color temperature; and a controller connected to the first driving node, the second driving node, the first LED output node and the second LED output node, between the LED driver and the plurality of LED strings. The controller includes a switching circuit connected to the first LED output node, the second LED output node and the second driving node, and is configured to adjust brightness of any one or any combination of the first LED string and the second LED string.

According to an aspect of an example embodiment, an LED device includes: a plurality of LEDs directly connected to at least a portion of a plurality of output terminals of an output harness of an LED driver; a power supply connected to a first output terminal of the plurality of output terminals and configured to generate a first internal power voltage and a second internal power voltage using a driving power received from the LED driver via the first output terminal; a controller configured to operate using the first internal power voltage and generate a PWM control signal based on a control command received from an external controller; and a switching circuit connected between one of the plurality of LEDs and a second output terminal of the plurality of output terminals, and configured to operate using the second internal power voltage and adjust brightness of a portion of the plurality of LEDs based on the PWM control signal.

BRIEF DESCRIPTION OF DRAWINGS

The above and other aspects, features, and advantages will be more apparent from the following description of example embodiments, taken in conjunction with the accompanying drawings, in which.

DETAILED DESCRIPTION

Figure 1:
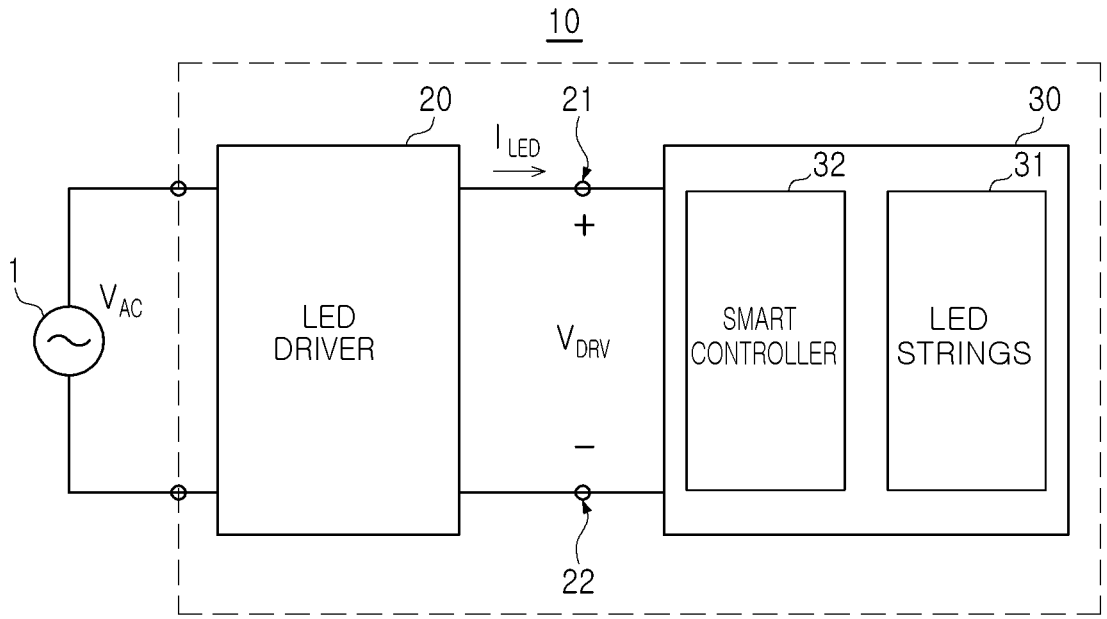
FIG. 1 is a block diagram schematically illustrating a lighting device according to an example embodiment.

The above and other aspects will be more apparent from the following description of example embodiments taken in conjunction with the accompanying drawings, in which:

FIG. 1 is a block diagram schematically illustrating a lighting device according to an example embodiment.

Referring to FIG. 1, a lighting device 10 according to an example embodiment may include an LED driver 20 connected to a power source 1, and an LED device 30. The LED device 30 may be connected to the LED driver 20 through a first driving node 21 and a second driving node 22, and the LED device 30 may operate by driving power $V_{DRV}$ output by the LED driver 20. For example, the LED driver 20 may output an LED current $I_{LED}$ for driving an LED, as a constant current.

The LED driver 20 may include a rectifier circuit rectifying AC power $V_{AC}$ output by the power source 1 to a DC power source, a converter circuit generating the driving power $V_{DRV}$, using the rectified DC power, and the like. According to example embodiments, an Electro-Magnetic Interference (EMI) filter or the like may be further connected between the power supply 1 and the rectifier circuit. The structure and operation of the LED driver 20 will be described later.

The LED device 30 may include LED strings 31, a smart controller 32 and the like. The LED strings 31 includes a plurality of LEDs operating as a light source, and the plurality of LEDs may be turned on by the driving power $V_{DRV}$.

For example, the plurality of LEDs included in the LED strings 31 may constitute a first LED string and a second LED string. The first LED string may emit light of a first color temperature, and the second LED string may emit light of a second color temperature. The first color temperature and the second color temperature may be different from each other. For example, LEDs included in the first LED string may output cool white light, and LEDs included in the second LED string may output warm white light. The first LED string and the second LED string may be connected to each other in parallel. In addition, the number of LED strings included in the LED strings 31 is not necessarily limited to two, and the LED strings 31 may include three or more LED strings.

The smart controller 32 may include a controller, a switching circuit, a power supply, and the like. The controller may be connected to an external controller or the like, which operates to generate a predetermined control signal, and the switching circuit may operate according to the control signal. For example, the switching circuit may be directly connected to the LED strings 31 and may control a plurality of LEDs included in the LED strings 31 according to a control signal. The power supply may generate an internal power voltage required to operate the controller and the switching circuit using the driving power $V_{DRV}$.

Figure 2:
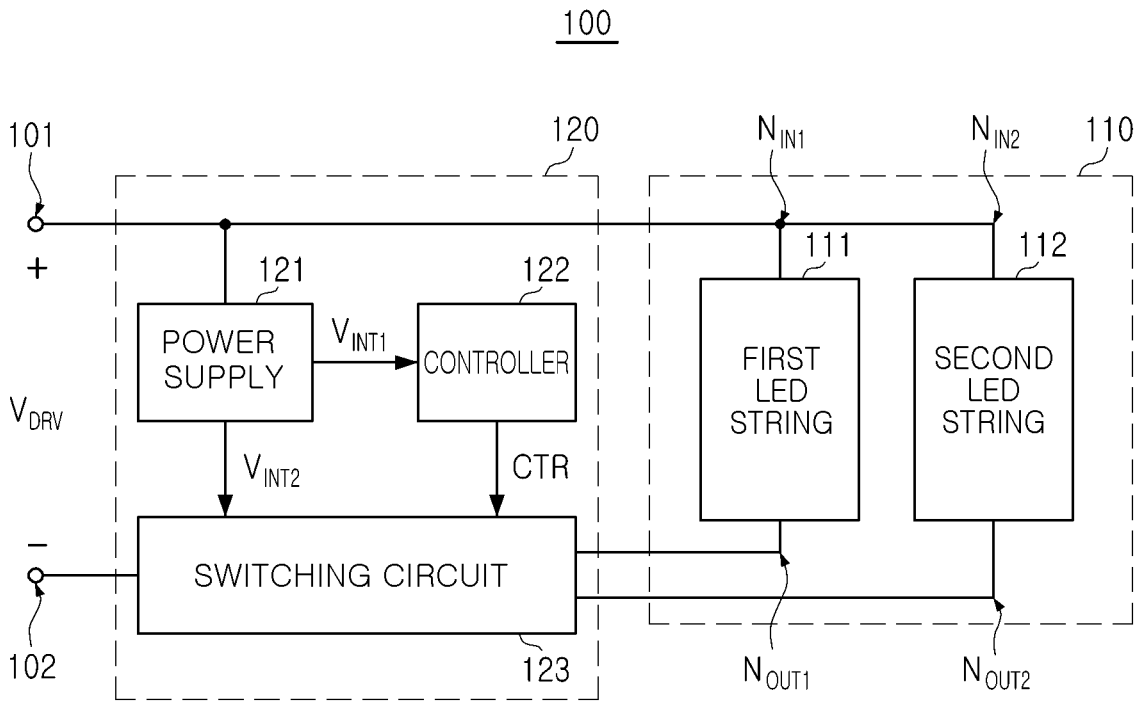
FIG. 2 is a block diagram schematically illustrating an LED device according to an example embodiment.

FIG. 2 is a block diagram schematically illustrating an LED device according to an example embodiment.

Referring to FIG. 2, an LED device 100 according to an example embodiment may include LED strings 110, a smart controller 120 and the like. The LED strings 110 includes a first LED string 111 and a second LED string 112, and as described above, the first LED string 111 and the second LED string 112 may be connected to each other in parallel and may emit light of different color temperatures.

The smart controller 120 may include a power supply 121, a controller 122, a switching circuit 123, and the like. The power supply 121 may generate internal power voltages $V_{INT1}$ and $V_{INT2}$ for the operation of the controller 122 and the switching circuit 123, using the driving power $V_{DRV}$. Depending on example embodiments, the operating voltage of the controller 122 and the operating voltage of the switching circuit 123 may be different from each other, and the power supply 121 may provide the first internal power voltage $V_{INT1}$ to the controller 122 and the second internal power voltage $V_{INT2}$ to the switching circuit 123. The power supply 121 may include a first regulator generating the first internal power voltage $V_{INT1}$ and a second regulator generating the second internal power voltage $V_{INT2}$.

The controller 122 may operate by receiving the first internal power voltage $V_{INT1}$ and may generate a control signal CTR controlling the switching circuit 123. For example, the control signal CTR may be a pulse width modulation (PWM) signal. The controller 122 may adjust the duty ratio of the control signal CTR according to a control command received from an external controller.

According to example embodiments, the controller 122 may be connected to an external controller through wired or wireless communication to receive a control command. For example, the controller 122 may include a wireless communication interface, and may be connected to an external controller through wireless communication such as BLUETOOTH™, ZIGBEE™, Wi-Fi, Li-Fi, and infrared communication. Alternatively, the controller 122 may include a wired communication interface, and may be connected to an external control through wired communication such as Digital Addressable Lighting Interface (DALI) or Digital Multiplex (DMX). The controller 122 may include a microcontroller unit (MCU), a communication circuit, an antenna, an oscillator, and the like, to operate by being connected to an external controller through various wired and wireless communication.

The microcontroller unit of the controller 122 may generate the control signal CTR using a control command received from an external controller through a communication circuit. As described above, the duty ratio of the control signal CTR may vary depending on a control command.

The switching circuit 123 may be connected to the first LED string 111 and the second LED string 112. In an example embodiment, the switching circuit 123 may include a switching device connected to at least one of the first LED string 111 and the second LED string 112, and a switch driver that controls on/off switching of the switching device. Depending on example embodiments, the number of each of the switching devices and the switch drivers included in the switching circuit 123 may vary. A detailed configuration of the switching circuit 123 will be described later with reference to FIGS. 3 to 6.

Referring to FIG. 2, the first LED string 111 may be connected between a first LED input node $N_{IN1}$ and a first LED output node $N_{OUT1}$, and the second LED string 112 may be connected between a second LED input node $N_{IN2}$ and a second LED output node $N_{OUT2}$. The first LED input node $N_{IN1}$ and the second LED input node $N_{IN2}$ may be connected to each other as illustrated in FIG. 2, and may be directly connected through an external LED driver and a first driving node 101. The first output LED node $N_{OUT1}$ and the second output LED node $N_{OUT2}$ may be separated from each other and may be connected to a second driving node 102 through the switching circuit 123. The switching device included in the switching circuit 123 may be connected to at least one of the first LED output node $N_{OUT1}$ and the second LED output node $N_{OUT2}$.

By separating the first LED output node $N_{OUT1}$ and the second LED output node $N_{OUT2}$ from each other and connecting the first and second LED output nodes $N_{OUT1}$ and $N_{OUT2}$ to the switching circuit 123, the output of at least one of the first LED string 111 and the second LED string 112 may be adjusted individually. Operation of the switching circuit 123 will be described in more detail with reference to FIGS. 3 to 6.

According to an example embodiment, the LED strings 110 and the smart controller 120 may be implemented on a single package substrate. As an example, the first LED string 111 and the second LED string 112 may be mounted on the front surface of the package substrate, and the power supply 121, the controller 122, the switching circuit 123 and the like may be mounted on the rear surface of the package substrate. As described above, by implementing both the LED strings 110 and the smart controller 120 on one package substrate, the LED device 100 may be manufactured in a form compatible with the existing LED module connected to the LED driver.

However, example embodiments are not limited thereto, and the smart controller 120 may also be implemented separately from the LED strings 110. As an example, the first LED string 111 and the second LED string 112 of the LED strings 110 may be implemented with a plurality of LEDs mounted on a predetermined package substrate, and the smart controller 120 may be implemented with ICs and devices mounted on a package substrate separate different from the LED strings 110. When the smart controller 120 is implemented in a separate package different from the LED strings 110 as described above, an antenna or the like included in the controller 122 of the smart controller 120 and communicating with an external controller may be disposed in the light emission direction of the LED strings 110. Accordingly, wireless communication performance between the external controller and the smart controller 120 may be improved.

FIGS. 3 to 6 are views illustrating operation of LED devices according to example embodiments.

As illustrated in FIGS. 3 to 6, LED strings 110 may include a first LED string 111 and a second LED string 112 connected to each other in parallel. The first LED string 111 may include first LEDs LED1, and the second LED string 112 may include second LEDs LED2. The first LED string 111 is connected between a first input node $I_{N1}$ and a first output node $N_{OUT1}$, the second LED string 112 is connected between a second input node $N_{IN2}$ and a second output node $N_{OUT2}$, and the first input node $I_{N1}$ and the second input node $N_{IN2}$ may be connected to each other. The first input node $N_{IN1}$ and the second input node $N_{IN2}$ are connected to the first driving node 101 and may receive driving power $V_{DRV}$.

Figure 3:
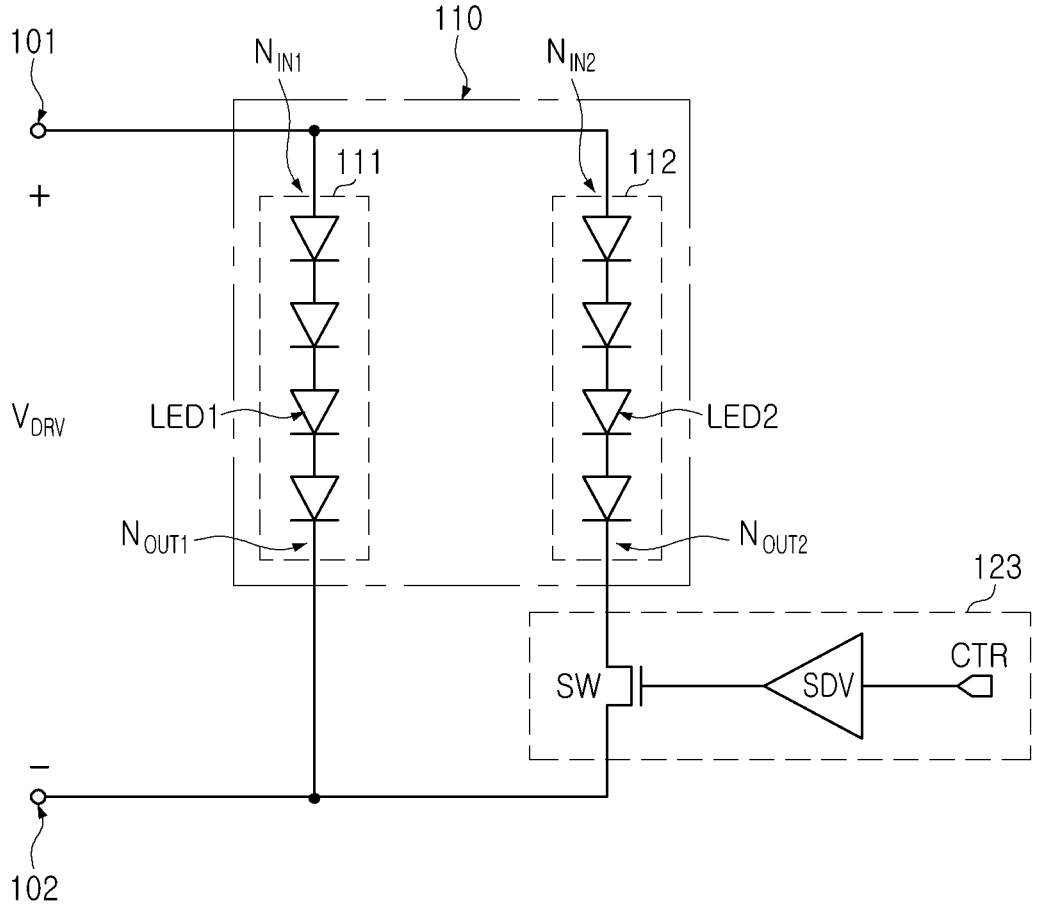
FIGS. 3 through 6 are views illustrating operation of LED devices according to example embodiments.

As illustrated in FIG. 3, the switching circuit 123 may include a switching device SW and a switch driver SDV. The switching device SW may be connected between the second output node $N_{OUT2}$ and the second driving node 102. The switch driver SDV operates by the control signal CTR, and the control signal CTR may be a PWM signal generated by the controller, as described above with reference to FIG. 2. For example, the switch driver SDV may control the switching device SW to turn on and off according to the control signal CTR. For example, the switching circuit 123 may control the duty ratio of the second LED string 112 according to the control signal CTR. For example, the switching circuit 123 may control a color temperature of light emitted by the LED strings 110 by controlling the duty ratio of the second LED string 112.

In the example embodiment illustrated in FIG. 3, control by the switching circuit 123 is not possible with respect to the first LED string 111, and only the duty ratio of the control signal CTR input to the second LED string 112 may be adjusted by the switching circuit 123. Therefore, although the control range of the color temperature of light emitted by the LED strings 110 may not be relatively great, because the switching circuit 123 is configured with only one switching device SW and one switch driver SDV, production costs, power consumption, and the like, may be reduced.

Figure 4:
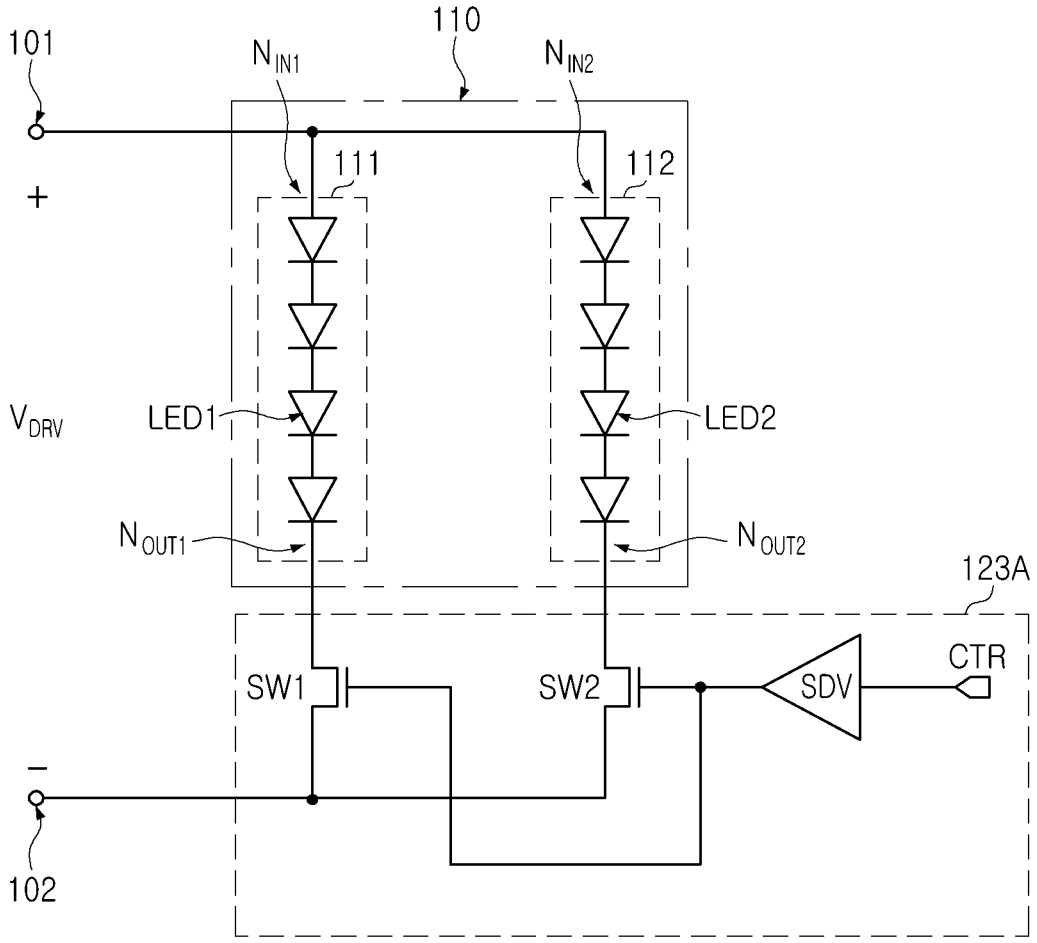

As illustrated in FIG. 4, a switching circuit 123A may include a first switching device SW1, a second switching device SW2, and a switch driver SDV. The first switching device SW1 may be connected between the first output node $N_{OUT1}$ and the second driving node 102 of the first LED string 111, and the second switching device SW2 may be connected between the second output node $N_{OUT2}$ and the second driving node 102.

In the example embodiment illustrated in FIG. 4, the first switching device SW1 may include a PMOS transistor, and the second switching device SW2 may include an NMOS transistor. Accordingly, the first LED string 111 and the second LED string 112 may be controlled using one switch driver SDV. For example, the switch driver SDV may control the first switching device SW1 and the second switching device SW2 to turn on and off according to the control signal CTR. For example, the first switching device SW1 and the second switching device SW2 may operate in opposite states according to the control signal CTR. For example, the switching circuit 123A may control the duty ratio of first LED string 111 and the second LED string 112 according to the control signal CTR. For example, the switching circuit 123A may control a color temperature of light emitted by the LED strings 110 by controlling the duty ratio of the first LED string 111 and the second LED string 112. However, because the first switching device SW1 and the second switching device SW2 are turned on and off by the same control signal CTR, it may be difficult to individually control the first LED string 111 and the second LED string 112, and therefore, the color temperature control range of the light emitted by the LED strings 110 may be limited.

Figure 5:
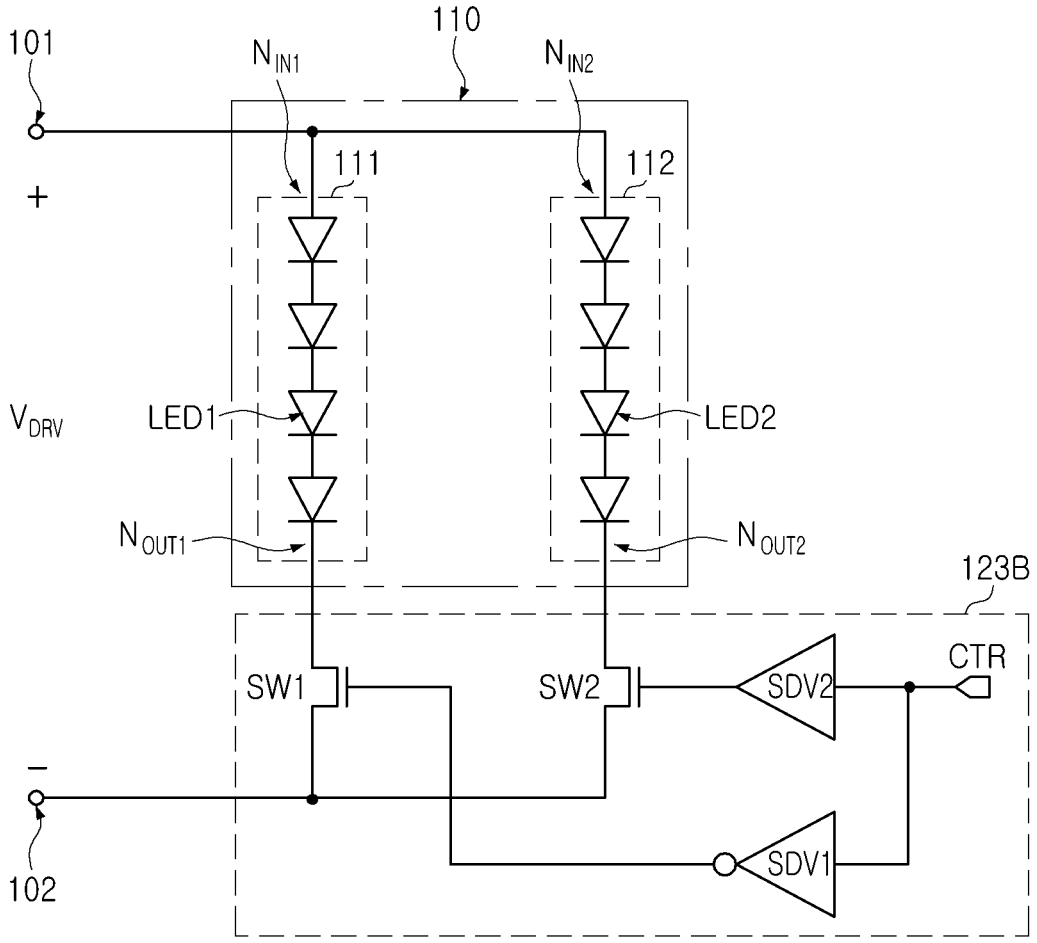

Referring to FIG. 5, a switching circuit 123B may include a first switching device SW1, a second switching device SW2, a first switch driver SDV1, and a second switch driver SDV2. For example, the first switching device SW1 and the second switching device SW2 may each include a PMOS transistor, or may each include an NMOS transistor. The first switch driver SDV1 may control the first switching device SW1 using a complementary signal of the control signal CTR received from the controller, and the second switch driver SDV2 may control the second switching device SW2 using the control signal CTR. For example, the first switching device SW1 and the second switching device SW2 may operate in opposite states according to the control signal CTR. For example, the switching circuit 123B may control the duty ratio of first LED string 111 and the second LED string 112 according to the control signal CTR. For example, the switching circuit 123A may control a color temperature of light emitted by the LED strings 110 by controlling the duty ratio of the first LED string 111 and the second LED string 112.

The operations of the switching circuits 123A and 123B illustrated in FIGS. 4 and 5, respectively, may be similar to each other. For example, referring to FIG. 5, when the duty ratio of the control signal CTR is 25%, the first switching device SW1 is controlled by a signal having a duty ratio of 75%, while the second switching device SW2 may be controlled by a signal having a duty ratio of 25%. Conversely, when the duty ratio of the control signal CTR is 75%, the first switching device SW1 is turned on/off by a signal having a duty ratio of 25%, whereas the second switching device SW2 may be turned on/off by a signal having a duty ratio of 75%.

Figure 6:
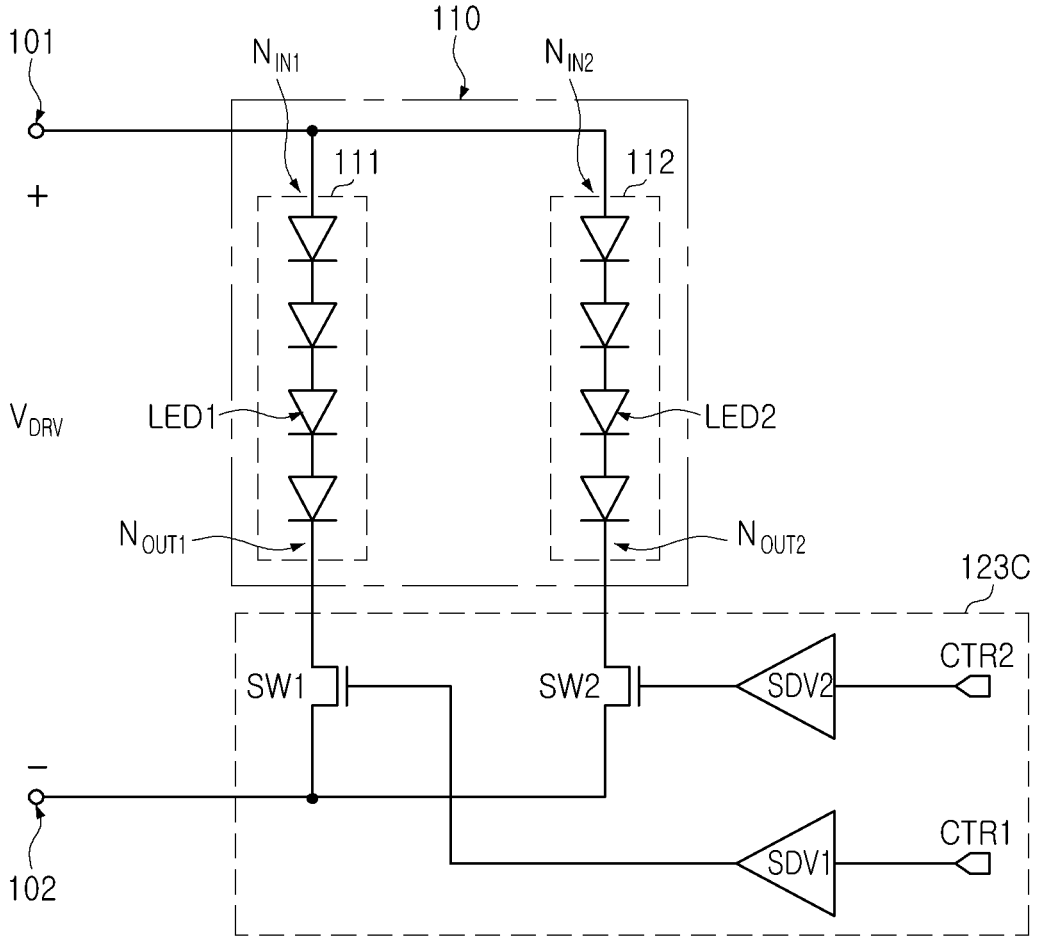

Referring to FIG. 6, a switching circuit 123C may include a first switching device SW1, a second switching device SW2, a first switch driver SDV1, and a second switch driver SDV2. In the example embodiment illustrated in FIG. 6, the first switch driver SDV1 and the second switch driver SDV2 may control the switching devices SW1 and SW2 by different control signals. The first switch driver SDV1 may control the first switching device SW1 by a first control signal CTR1, and the second switch driver SDV2 may control the second switching device SW2 by a second control signal CTR2.

The first control signal CTR1 and the second control signal CTR2 are signals generated by the controller included in the smart controller together with the switching circuit 123C, and the duty ratio of the first control signal CTR1 and the duty ratio of the second control signal CTR2 may be determined independently of each other. In detail, the duty ratio of the first control signal CTR1 may be determined regardless of the duty ratio of the second control signal CTR2. For example, the switching circuit 123C may control the duty ratio of first LED string 111 according to the first control signal CTR1, and control the duty ratio of the second LED string 112 according to the second control signal CTR2. For example, the switching circuit 123C may control a color temperature of light emitted by the LED strings 110 by independently controlling the duty ratio of the first LED string 111 and the second LED string 112. Accordingly, compared to the example embodiments described with reference to FIGS. 3 to 5, the control range of the color temperature of light emitted by the LED strings 110 may be increased, and the brightness of light emitted by the LED strings 110 may also be adjusted.

In an example embodiment, the first LED string 111 may emit cool white light, and the second LED string 112 may emit warm white light. As an example, it is assumed that the first color temperature of light emitted by the first LED string 111 is approximately 6000K, a cool white series, and the second color temperature of light emitted by the second LED string 112 is approximately 2700K, a warm white series. Therefore, a color temperature (CCT) of light emitted by the LED strings 110 may be determined according to the duty ratio of the first control signal CTR1 for determining on/off switching of the first switching device SW1 and the second control signal CTR2 for determining on/off switching of the second switching device SW2, as illustrated in Table 1.

TABLE 1

| Duty ratio of first control signal | Duty ratio of second control signal | Color temperature of light |
|---|---|---|
| 100% | 0% | 6000 K |
| 75% | 25% | 5175 K |
| 50% | 50% | 4350 K |
| 25% | 75% | 3525 K |
| 0% | 100% | 2700 K |

The combination of the duty ratio of the first control signal CTR1 and the second control signal CTR2 described as an example in Table 1 may also be implemented in the switching circuits 123A and 123B according to the example embodiments illustrated in FIGS. 4 and 5. However, as described above, in the case of the switching circuit 123C, according to the example embodiment illustrated in FIG. 6, because the first switching device SW1 and the second switching device SW2 are controlled by the first control signal CTR1 and the second control signal CTR2 individually generated by the controller, the color temperature of light emitted by the LED strings 110 may be changed to have various values.

Figure 7:
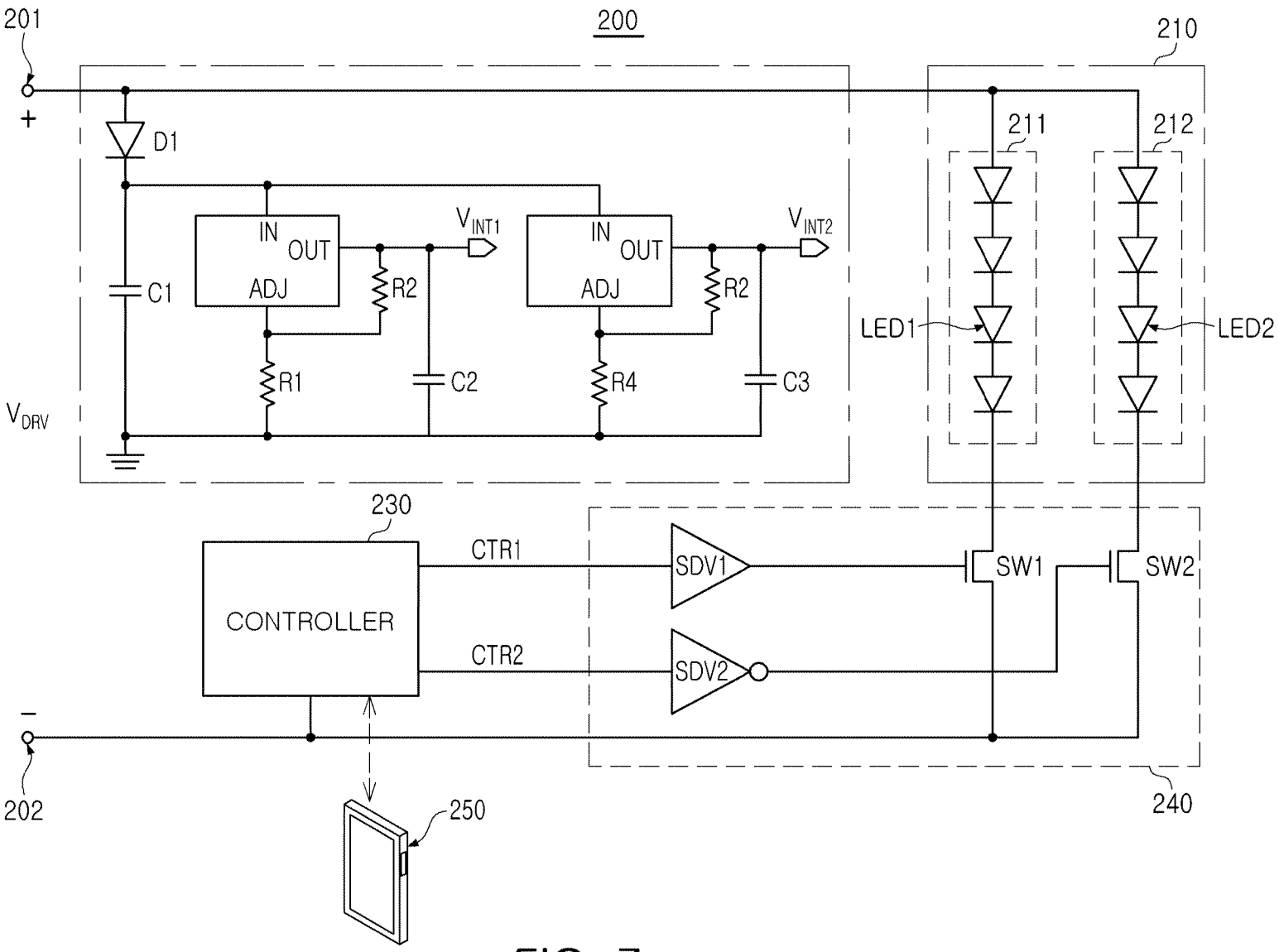
FIG. 7 is a schematic diagram of an LED device according to an example embodiment.

FIG. 7 is a schematic diagram of an LED device according to an example embodiment.

Referring to FIG. 7, an LED device 200 according to an example embodiment may include LED strings 210, a power supply 220, a controller 230, and a switching circuit 240. The LED device 200 may be connected to an external LED driver through the first driving node 201 and the second driving node 202. In the example embodiment illustrated in FIG. 7, the configuration of the LED strings 210 and the switching circuit 240 may be similar to that described with reference to FIG. 6.

For example, the LED strings 210 may include a first LED string 211 including first LEDs (LED1) emitting light of a first color temperature, and a second LED string 212 including second LEDs (LED2) emitting light of a second color temperature. The switching circuit 240 may include a first switching device SW1 connected to the first LED string 211, a second switching device SW2 connected to the second LED string 212, and switch drivers SDV1 and SDV2. On/off switching of the first switching device SW1 may be controlled by the first switch driver SDV1 according to the first control signal CTR1, and on/off switching of the second switching device SW2 may be controlled by the second switch driver SDV2 according to the second control signal CTR2.

The power supply 220 may include a first regulator 221 and a second regulator 222. Each of the first regulator 221 and the second regulator 222 may include an input terminal IN, an output terminal OUT, a resistance terminal ADJ connected to resistors, and the like.

The respective input terminals IN of the first regulator 221 and the second regulator 222 may be connected to a node between first diode D1 and first capacitor C1, and the first diode D1 may be connected to a first driving node 201. Accordingly, the driving power $V_{DRV}$ may be input through the input terminal IN. The output terminal OUT may be connected to a second capacitor C2 or a third capacitor C3 functioning as an output capacitor. In addition, the first resistor R1 and the second resistor R2 may be connected to the output terminal OUT in the first regulator 221. The node between the first resistor R1 and the second resistor R2 is connected to the resistance terminal ADJ of the first regulator 221, and the magnitude of the first internal power voltage $V_{INT1}$ may be determined depending on a resistance value of each of the first resistor R1 and the second resistor R2. Similarly, the magnitude of the second internal power voltage $V_{INT2}$ may be determined according to a resistance value of each of a third resistor R3 and a fourth resistor R4.

In an example embodiment, the first internal power voltage $V_{INT1}$ is a power voltage for the operation of the controller 230, the second internal power voltage $V_{INT2}$ is a power voltage for the operation of the switching circuit 240, and the magnitude of the first internal power voltage $V_{INT1}$ may be less than that of the second internal power voltage $V_{INT2}$. However, example embodiments are not limited thereto, and the respective magnitudes of the first internal power voltage $V_{INT1}$ and the second internal power voltage $V_{INT2}$ may vary depending on example embodiments.

The controller 230 may generate the first control signal CTR1 and the second control signal CTR2 as PWM signals. The first control signal CTR1 may be input to the first switch driver SDV1 to control the first switching device SW1, and the second control signal CTR2 may be input to the second switch driver SDV2 to control the second switching device SW2. In the example embodiment illustrated in FIG. 7, on/off switching of the first switching device SW1 and the second switching device SW2 are independently controlled by the first control signal CTR1 and the second control signal CTR2, respectively, and the color temperature and/or brightness of light emitted by the LED strings 210 may be variously adjusted.

The controller 230 may be connected to the external controller 250 through various wired/wireless communication methods. For example, the external controller 250 may be a mobile device such as a smartphone or a tablet PC, or a lighting controller fixedly installed in a space close to the LED device 200.

The user may monitor the state of the LED driver supplying driving power $V_{DRV}$ to the LED device 200 as well as the state of the LED strings 210 included in the LED device 200, through the external controller 250. For example, when a failure occurs in at least one of the first LEDs (LED1), the voltage applied to the entire first LED string 211 may be changed. The LED device 200 monitors the voltage and current of the respective LED strings 211 and 212 to monitor whether the LEDs LED1 and LED2 fail, as well as power consumption.

The power consumption of the LED driver that supplies the driving power $V_{DRV}$ to the LED device 200 is determined by a maximum value of the rated voltage of the LED driver and a rated current, and may be described in the specifications of the LED driver. However, if the forward voltage of the LEDs (LED1 and LED2) included in the LED strings 210 corresponds to a relatively low voltage among the rated voltage range of the LED driver, a difference may occur between the power consumption described in the specifications of the LED driver and the power actually consumed by the LED strings 210. In an example embodiment, the LED device 200 may include a voltage/current detection circuit connected to the LED strings 210. By including the voltage/current detection circuit, the controller 230 may calculate the actual power consumption of the LED strings 210 and transmit the calculated power consumption to the external controller 250, to notify the user.

In addition, the LED device 200 according to an example embodiment may determine whether flicker occurs in the LED strings 210. As described above, the LED device 200 may include a voltage/current detection circuit that detects the voltage/current of the LED strings 210 and transmits the detected voltage/current to the controller 230. In this case, the controller 230 may determine whether flicker occurs using a ripple component included in the current detected from the LED strings 210 and transmit the determination result to the external controller 250. Alternatively, a separate optical sensor for detecting light emitted by the LED strings 210 may be added to the LED device 200, and the controller 230 may calculate an accurate flicker index using an output of the optical sensor. The flicker index is determined to be a value between 0 and 1, and may have a higher value (i.e., closer to 1) as flicker severity increases.

Figure 8:
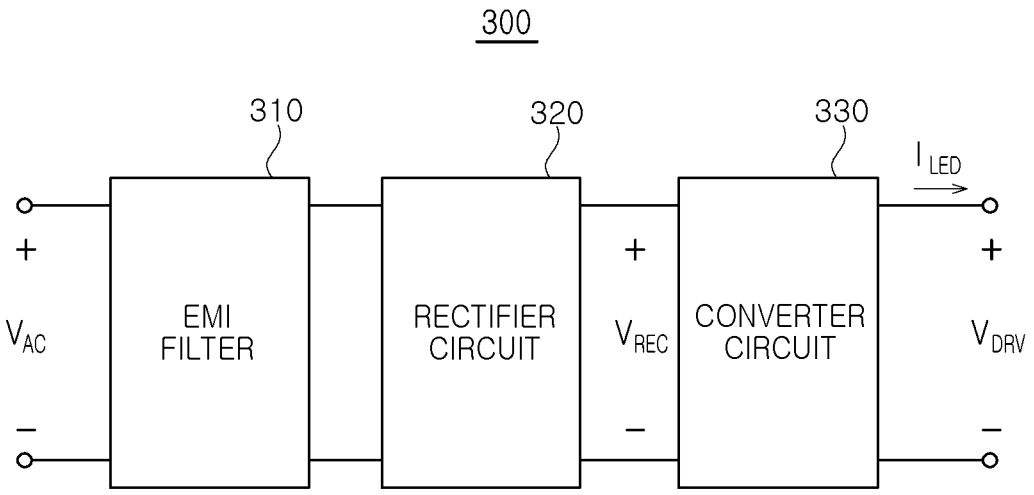
FIG. 8 is a block diagram schematically illustrating an LED driver included in a lighting device according to an example embodiment.

FIG. 8 is a block diagram schematically illustrating an LED driver included in a lighting device according to an example embodiment.

Referring to FIG. 8, an LED driver 300 according to an example embodiment may include an EMI filter 310, a rectifier circuit 320, a converter circuit 330, and the like. The EMI filter 310 may receive AC power $V_{AC}$ and may filter electromagnetic waves included in the AC power $V_{AC}$. The rectifier circuit 320 may convert the AC power $V_{AC}$ filtered by the EMI filter 310 into DC power. In an example embodiment, the rectifier circuit 320 may include a diode bridge.

The converter circuit 330 supplies driving power $V_{DRV}$ to a plurality of LEDs, and may be configured in various manners according to example embodiments. For example, the converter circuit 330 may include a Power Factor Correction (PFC) converter that improves power factor and increases a voltage, and a DC-DC converter. The converter circuit 330 may generate driving power $V_{DRV}$ for driving the plurality of LEDs using rectified power $V_{REC}$ generated as the rectifier circuit 320 rectifies the AC power $V_{AC}$. The voltage level of the driving power $V_{DRV}$ may be determined by characteristics of a plurality of LEDs connected to the output terminal of the converter circuit 330, for example, a forward voltage of each of the LEDs or the like. In an example embodiment, the LED driver 300 may output an LED current $I_{LED}$ for driving the LED, as a constant current.

Figure 9:
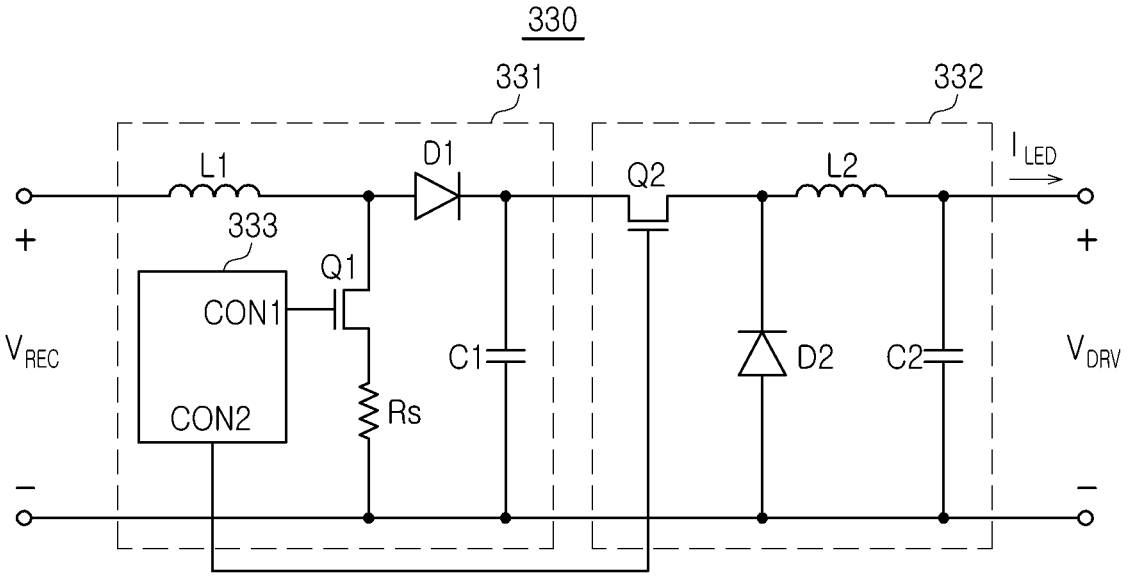
FIG. 9 is a circuit diagram schematically illustrating a converter circuit of an LED driver included in a lighting device according to an example embodiment.

FIG. 9 is a circuit diagram schematically illustrating a converter circuit of LED driver included in a lighting device according to an example embodiment.

For example the converter circuit illustrated in FIG. 9 may be the converter circuit 330 included in the LED driver 300 in the example embodiment illustrated in FIG. 8. Referring to FIG. 9, the converter circuit 330 may include a PFC converter 331, a DC-DC converter 332, a controller 333, and the like. The PFC converter 331 may operate as a boost converter circuit boosting the rectified voltage $V_{REC}$, and may include a first inductor L1, a first diode D1, a first capacitor C1, a first converter switch Q1, and the like.

When the first converter switch Q1 is turned on by the controller 333, a current by the rectified power $V_{REC}$ flows to a switch resistor $R_S$, thereby charging energy in the first inductor L1. On the other hand, when the controller 333 turns the first converter switch Q1 off, the current charged in the first inductor L1 may be discharged and a voltage greater than the rectified voltage $V_{REC}$ input to the PFC converter 331 may be generated. In this case, a high frequency component may be removed by the first capacitor C1 connected to the first diode D1.

The DC-DC converter 332 connected to the PFC converter 331 in series may operate as a buck converter circuit, and may include a second inductor L2, a second diode D2, a second capacitor C2, and a second converter switch Q2. Similarly to the first converter switch Q1, the second converter switch Q2 may be controlled by the controller 333.

When the controller 333 turns the second converter switch Q2 on, energy may be charged in the second inductor L2 while current flows to the second inductor L2. On the other hand, when the controller 333 turns the second converter switch Q2 off, a current flows by energy charged in the second inductor L2, and the driving power $V_{DRV}$ may be output. The second diode D2 provides a path through which current may flow when the second converter switch Q2 is turned off, and the second capacitor C2 may function as a rectifying capacitor.

The LED current $I_{LED}$ that the LED driver 300 outputs to the plurality of LEDs by the converter circuit 330 may have a fixed value. In addition, the LED driver 300 may have a rated voltage within a predetermined range, and power consumption of the LED driver 300 may be determined by a maximum value of the rated voltage and the LED current $I_{LED}$. The LED current $I_{LED}$, rated voltage, and power consumption of the LED driver 300 may be provided as specifications of the LED driver 300.

However, in a case in which the sum of the forward voltages of the plurality of LEDs corresponds to a middle or lower portion of the rated voltage range for reasons such as failure in at least a portion of the plurality of LEDs connected to the LED driver 300, power consumption of a plurality of LEDs connected as a load to the LED driver 300 may be reduced. Accordingly, there may be a difference between the power consumption described in the specifications of the LED driver 300 and the power actually consumed by the LED driver 300 in operation.

In an example embodiment, the above problem may be prevented using a smart controller included in the LED device together with a plurality of LEDs connected to the LED driver 300. The smart controller may monitor the power actually consumed by the LED driver 300 by detecting a voltage applied to the plurality of LEDs and a current flowing through the plurality of LEDs. For example, when it is detected that a relatively low voltage is applied to one of the LED strings constituted by the plurality of LEDs, it may be determined that a portion of the LEDs included in the corresponding LED string have failed. The LED driver 300 may generate a signal indicating failure of the portion of the LEDs. Accordingly, the state of the LED strings connected to the LED driver 300 as well as the power consumption of the LED driver 300 may be monitored.

As described above, the smart controller may be connected to an external controller through wired or wireless communication. The external controller may be a device such as a smart phone or the like, and may receive an indication that the portion of the LEDs has failed, for example through a wireless notification from the LED driver 300. Therefore, the user may check the status of the LED driver 300 and the LED strings using an application of the external controller interlocked with the smart controller.

Figure 10:
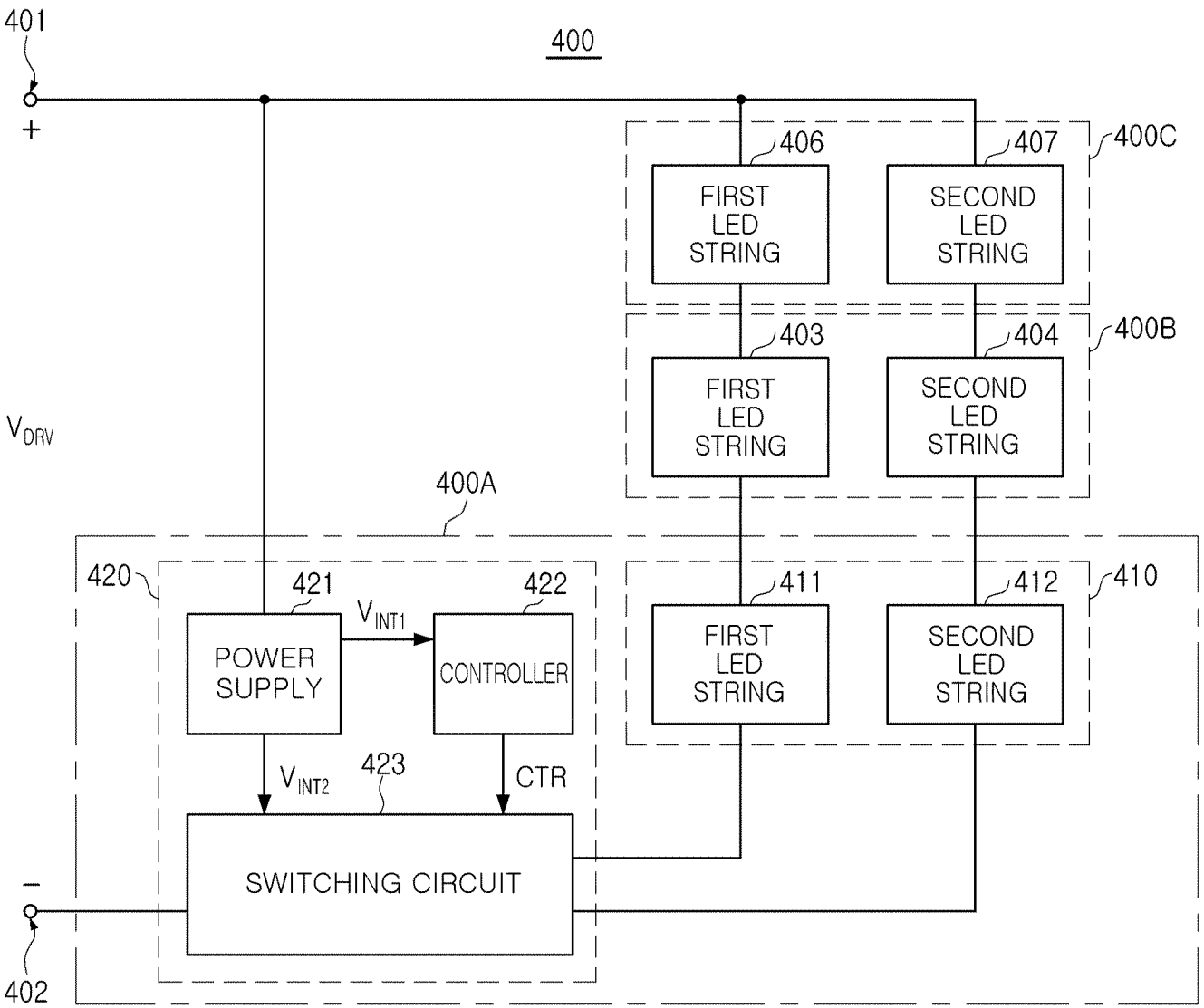
FIG. 10 is a schematic view illustrating an LED device according to an example embodiment.

FIG. 10 is a schematic view illustrating an LED device according to an example embodiment.

As illustrated in FIG. 10, an LED device 400 according to an example embodiment may include one master device 400A and a plurality of slave devices 400B and 400C. The master device 400A may include LED strings 410 and a smart controller 420. The smart controller 420 includes a power supply 421, a controller 422, a switching circuit 423, and the like, and the operation of respective components may be similar to that in the example embodiment described with reference to FIG. 2 above.

In the LED device 400 according to the example embodiment illustrated in FIG. 10, the plurality of slave devices 400B and 400C may be further connected to the master device 400A. In an example embodiment, each of the plurality of slave devices 400B and 400C may include only a plurality of LEDs. Referring to FIG. 10, first slave device 400B may include a first LED string 403 and a second LED string 404, and second slave device 400C may include a first LED string 406 and a second LED string 407. In detail, the smart controller 420 may not be included in each of the plurality of slave devices 400B and 400C.

First LED strings 403, 406 and 411 included in the master device 400A and the plurality of slave devices 400B and 400C may be connected to each other in series, and the second LED strings 404, 407 and 412 may also be connected to each other in series. Accordingly, as the switching devices in the switching circuit 423 are turned on/off at a predetermined duty ratio by the control signal CTR output by the controller 422 of the smart controller 420, the brightness of the first LED strings 403, 406 and 411 may be simultaneously adjusted, and the brightness of the second LED strings 404, 407 and 412 may be simultaneously adjusted. In this manner, controller a plurality of devices 400A, 400B and 400C each including a plurality of LEDs may be simultaneously controlled by the smart controller 420 which is provided in only one of the devices, master device 400A.

Figure 11:
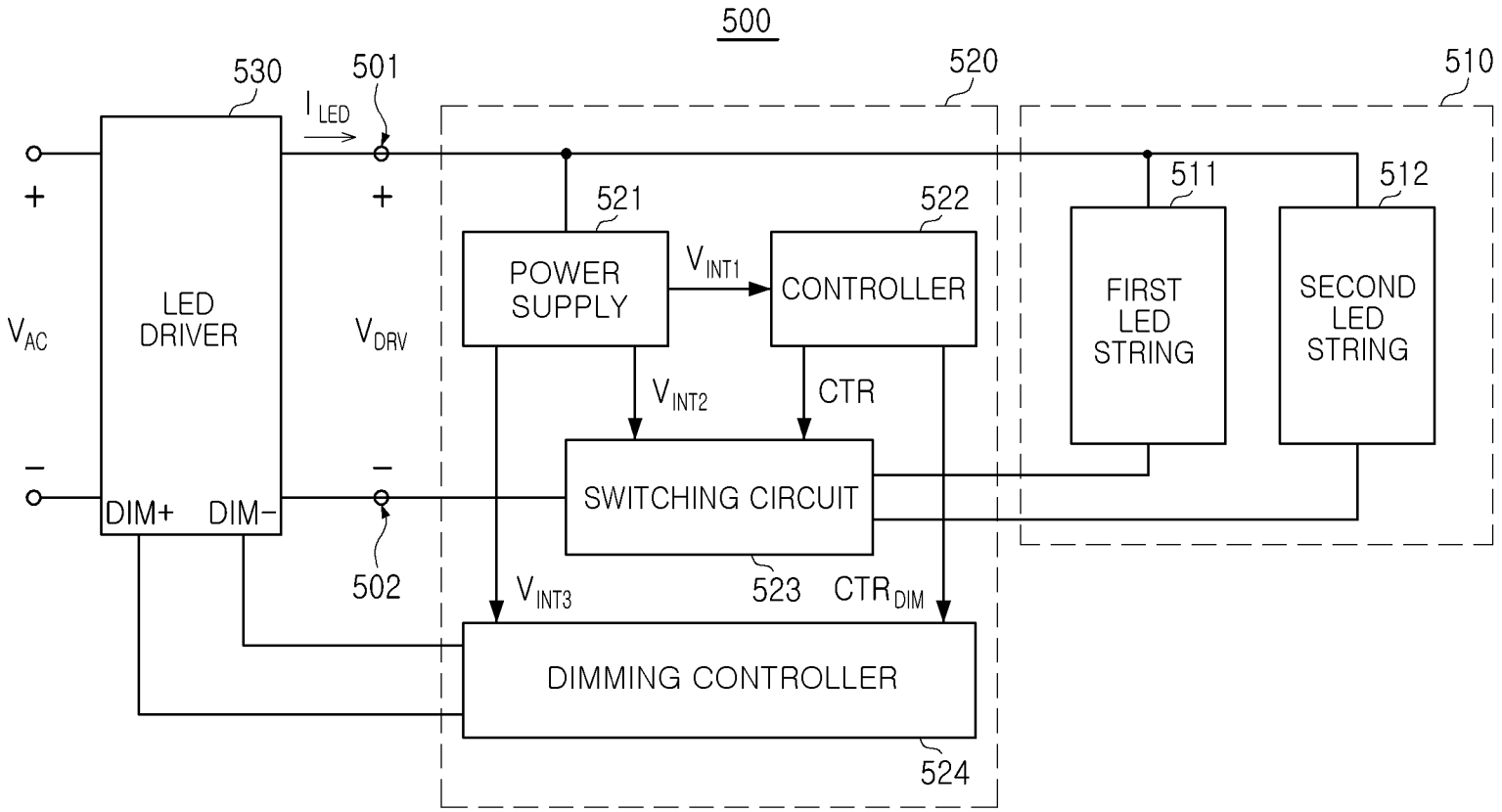
FIGS. 11 and 12 are schematic views illustrating lighting devices according to example embodiments.
Figure 12:
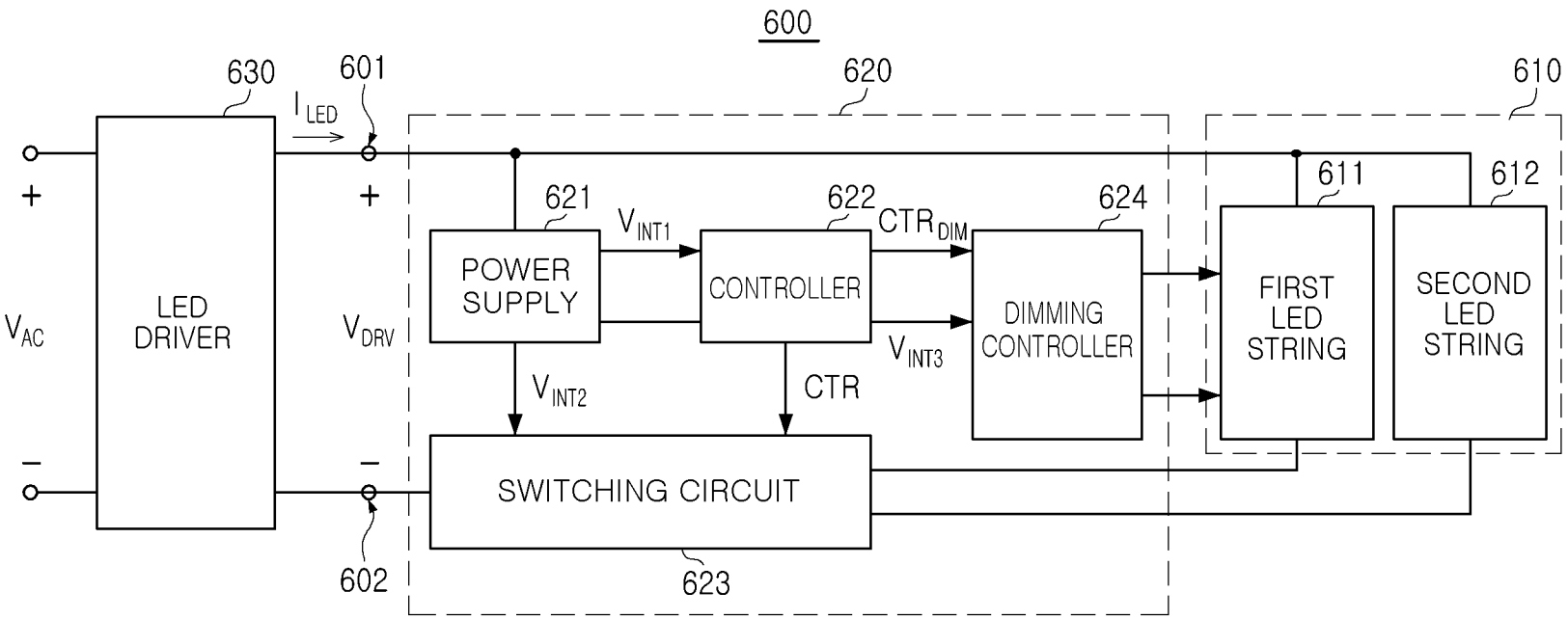

FIGS. 11 and 12 are views schematically illustrating lighting devices according to example embodiments.

FIGS. 11 and 12 are diagrams provided to illustrate lighting devices 500 and 600 that provide a dimming function. As illustrated in FIG. 11, the lighting device 500 may include LED strings 510, a smart controller 520, an LED driver 530, and the like. The LED driver 530 may receive AC power $V_{AC}$ and generate driving power $V_{DRV}$. According to example embodiments, the LED strings 510 and the smart controller 520 may be included in a single package and implement an LED device, and the first LED string 511 and the second LED string 512 of the LED strings 510 may be operated by the driving power supply $V_{DRV}$. The LED strings 510 and the smart controller 520 are connected to the LED driver 530 through the first driving node 501 and the second driving node 502, and may be packaged together to configure an LED device.

In the example embodiment illustrated in FIG. 11, the smart controller 520 may include a power supply 521, a controller 522, a switching circuit 523, a dimming controller 524, and the like. The power supply 521 outputs a first internal power voltage $V_{INT1}$, a second internal power voltage $V_{INT2}$, and a third internal power voltage $V_{INT3}$, and the controller 522 may operate by the first internal power voltage $V_{INT1}$, and the switching circuit 523 may operate by the second internal power voltage $V_{INT2}$. The controller 522 outputs a control signal CTR for controlling the switching circuit 523 and a dimming control signal $CTR_{DIM}$ for controlling the dimming controller 524, and in an example embodiment, the control signal CTR and the dimming control signal $CTR_{DIM}$ may be PWM signals. Detailed operations of the power supply 521, the controller 522, and the switching circuit 523 may be understood with reference to the example embodiments described above.

The dimming controller 524 operates by the third internal power voltage $V_{INT3}$ and may generate a dimming control voltage according to the dimming control signal $CTR_{DIM}$. In the example embodiment illustrated in FIG. 11, the LED driver 530 may provide a dimming function, and thus, may include dimming control terminals DIM+ and DIM− as illustrated in FIG. 11. The dimming controller 524 may output the dimming control voltage generated according to the dimming control signal $CTR_{DIM}$ to the dimming control terminals DIM+ and DIM−.

For example, the dimming control signal $CTR_{DIM}$ may be a PWM signal, and the dimming controller 524 may determine the level of the dimming control voltage according to the duty ratio of the dimming control signal $CTR_{DIM}$. For example, assuming that the dimming control voltage outputting maximum brightness is 3 V, the dimming control voltage may be 1.5 V when the duty ratio of the dimming control signal $CTR_{DIM}$ is 50%. In addition, when the duty ratio of the dimming control signal $CTR_{DIM}$ is 30%, the dimming control voltage may be 0.9 V, and when the duty ratio of the dimming control signal $CTR_{DIM}$ is 80%, the dimming control voltage may be 2.4 V. The magnitude of the LED current $I_{LED}$ output by the LED driver 530 is changed depending on the magnitude of the dimming control voltage, and thus, the brightness of the light emitted by the LED strings 510 may be adjusted.

Next, referring to FIG. 12, a lighting device 600 may include LED strings 610, a smart controller 620, an LED driver 630, and the like. The smart controller 620 may include a power supply 621, a controller 622, a switching circuit 623, a dimming controller 624, and the like.

In contrast to the example embodiment illustrated in FIG. 11, the LED driver 630 in the example embodiment illustrated in FIG. 12 does not provide a dimming function and may not include a dimming control terminal. Accordingly, as described with reference to FIG. 11, the dimming function may not be implemented in a manner in which the dimming controller 624 determines the magnitude of the dimming control voltage according to the duty ratio of the dimming control signal $CTR_{DIM}$.

To implement the dimming function in the case of connection to the LED driver 630 that does not provide a dimming function, the dimming controller 624 may be connected to the first LED string 611 and the second LED string 612 of the LED strings 610. For example, the dimming controller 624 may adjust the number of LEDs that actually emit light in each of the first LED string 611 and the second LED string 612, according to the duty ratio of the dimming control signal $CTR_{DIM}$. Accordingly, in the example embodiment illustrated in FIG. 12, although the magnitude of the LED current $I_{LEA}$ output by the LED driver 630 does not change, the intensity of light emitted by the LED strings 610 may be changed, which will be described below in more detail with reference to FIG. 13.

Figure 13:
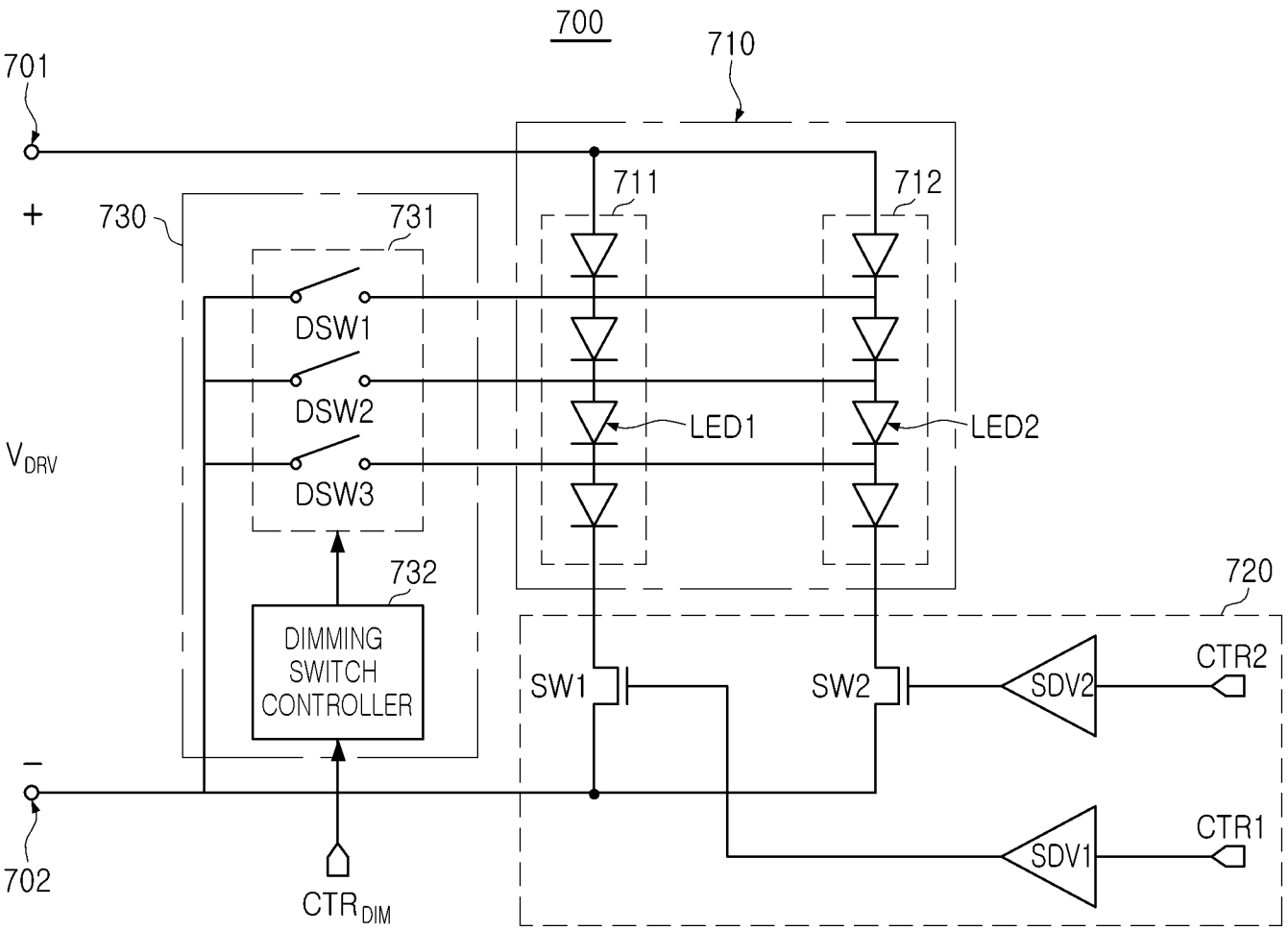
FIG. 13 is a view illustrating a dimming function of an LED device according to an example embodiment.

FIG. 13 is a view illustrating the dimming function of the LED device according to an example embodiment.

FIG. 13 illustrates operation of a dimming controller included in an LED device connected to an LED driver that does not provide a dimming function. Referring to FIG. 13, an LED device 700 may include LED strings 710, a switching circuit 720, a dimming controller 730 and the like. The switching circuit 720 may control on/off switching of the first switching device SW1 and the second switching device SW2 by the first and second control signals CTR1 and CTR2 transmitted from the controller.

The dimming controller 730 includes a switching unit 731 and a switch control circuit 732, and the switching unit 731 may include a plurality of dimming control switches DSW1-DSW3. The plurality of dimming control switches DSW1-DSW3 may be connected to the first LED string 711 and the second LED string 712. As illustrated in FIG. 13, each of the plurality of dimming control switches DSW1-DSW3 may be connected to a node between the first LEDs LED1 and a node between the second LEDs LED2.

The switch control circuit 732 may control on/off switching of the plurality of dimming control switches DSW1-DSW3 according to the dimming control signal $CTR_{DIM}$ transmitted from the controller. For example, the dimming control signal $CTR_{DIM}$ may be a PWM signal, and the switch control circuit 732 may turn on or turn off each of the plurality of dimming control switches DSW1-DSW3 according to the duty ratio of the dimming control signal $CTR_{DIM}$. For example, when the duty ratio of the dimming control signal $CTR_{DIM}$ is 50%, the switch control circuit 732 may turn the second dimming control switch DSW2 on, and may turn the first and third dimming control switches DSW1 and DSW3 off. Similarly, when the duty ratio of the dimming control signal $CTR_{DIM}$ is 25%, the switch control circuit 732 may turn the first dimming control switch DSW1 on, and may turn the second and third dimming control switches DSW2 and DSW3 off. In an example embodiment, when the duty ratio of the dimming control signal $CTR_{DIM}$ is greater than 25% and less than 50%, the plurality of dimming control switches DSW1-DSW3 may be respectively turned on or turned off in the same manner as when the duty ratio of the dimming control signal $CTR_{DIM}$ is 50%.

In the example embodiment illustrated in FIG. 13, a dimming function can be implemented when the LED driver does not have dimming control terminals. Merely, when one of the plurality of dimming control switches DSW1-DSW3 is turned on, current input to the LED strings 710 cannot be flew through the switching circuit 720. Therefore, when the dimming function is activated, a color temperature of light output by the LED strings 710 may not be adjusted.

Figure 14:
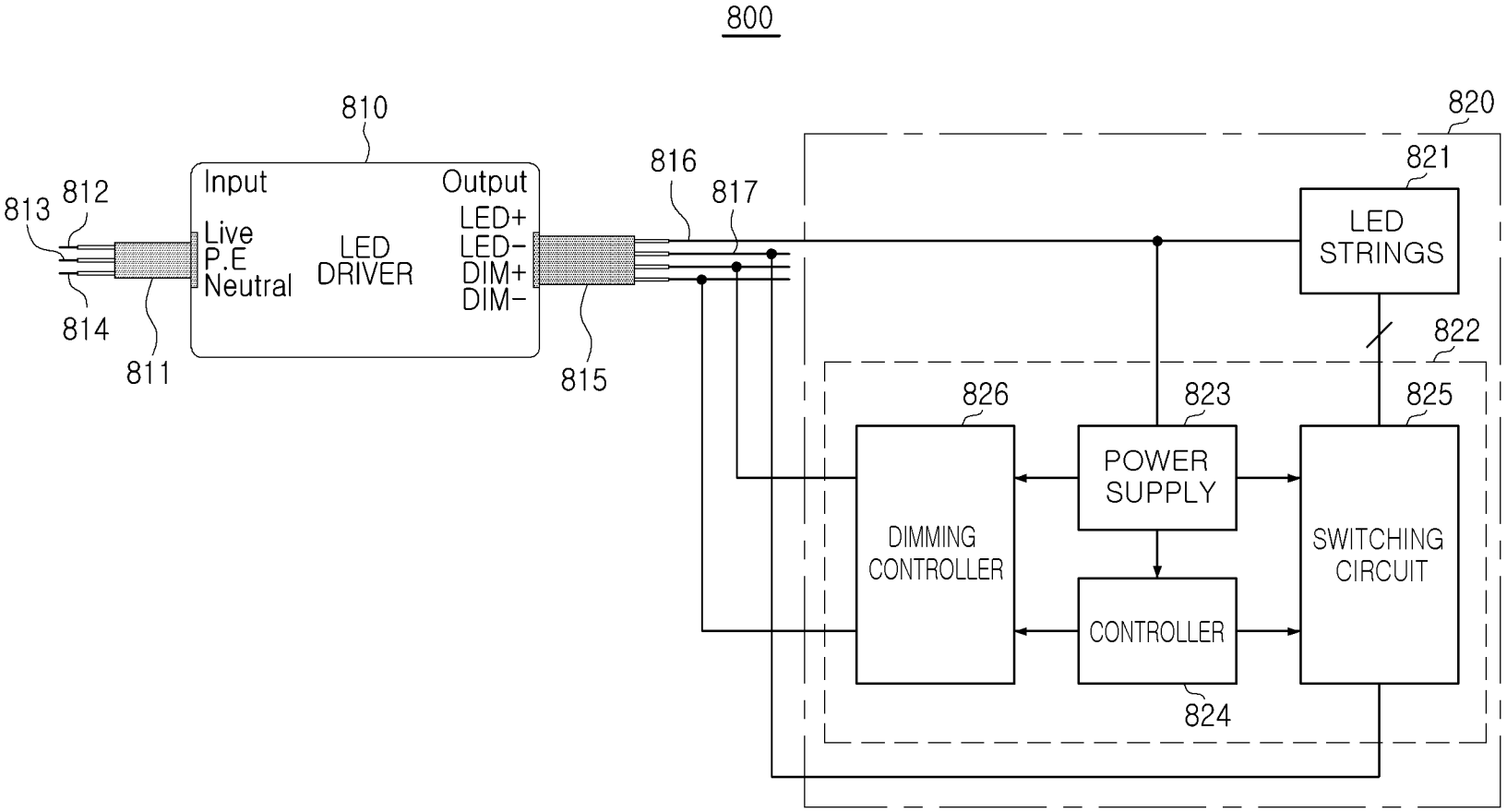
FIGS. 14 and 15 are diagrams illustrating connection methods between an LED device and an LED driver according to example embodiments.
Figure 15:
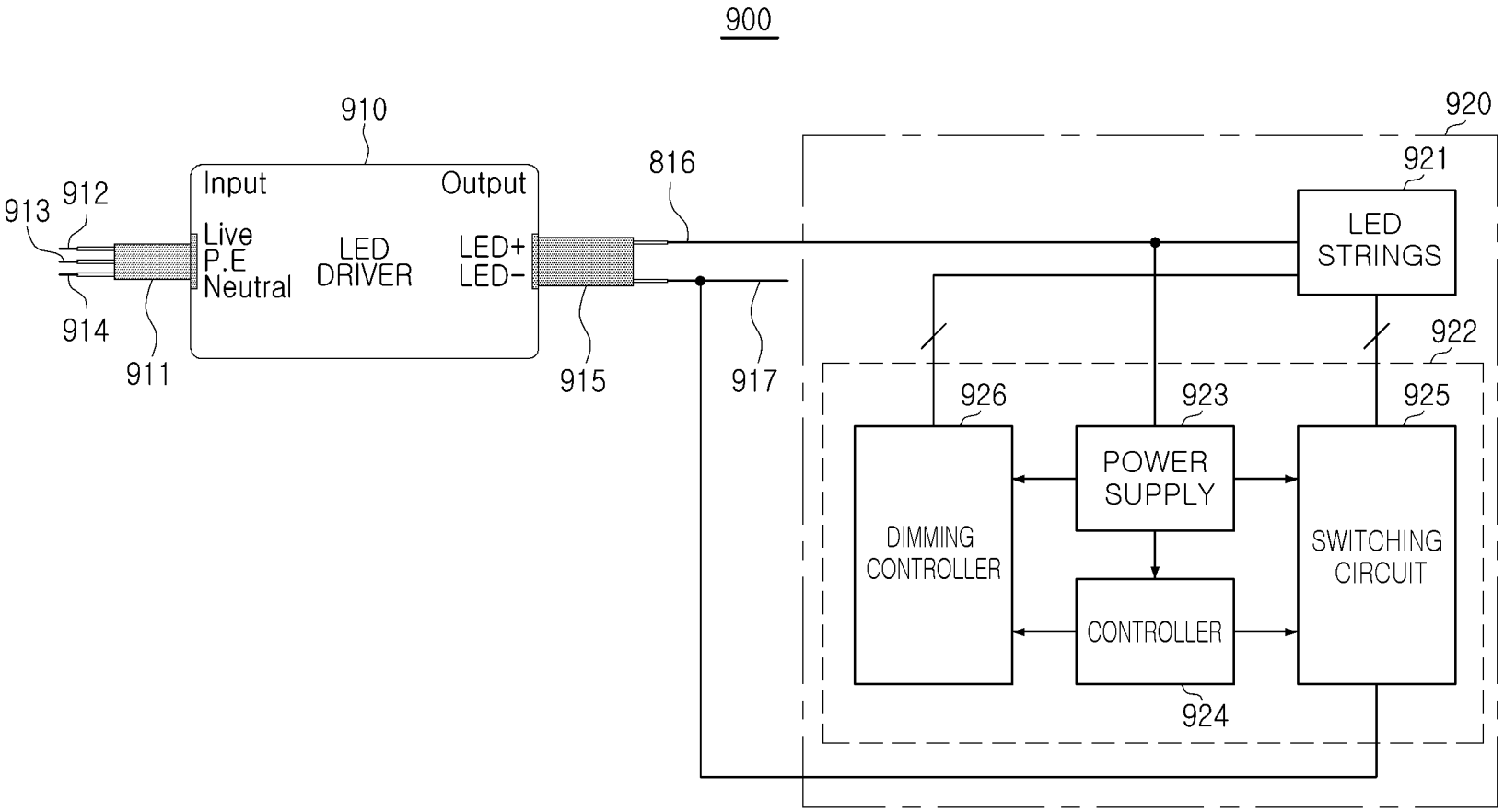

FIGS. 14 and 15 are diagrams illustrating connection methods between an LED device and an LED driver according to example embodiments.

FIG. 14 is a diagram illustrating a connection method between an LED driver 810 providing a dimming function and an LED device 820. Referring to FIG. 14, the LED driver 810 may be connected to an input harness 811 and an output harness 815. The input harness 811 may include a plurality of input terminals 812-814 receiving AC power, and the output harness 815 may include a plurality of output terminals 816-819 transmitting driving power generated by the LED driver to the LEDs. Among the plurality of output terminals, a first output terminal 816 and a second output terminal 817 may be terminals for outputting driving power. For example, the voltage output to the first output terminal 816 may be greater than the voltage output to the second output terminal 817.

The LED driver 810 may generate driving power using the AC power received through the input harness 812. The LED driver 810 may include an EMI filter, a rectifier circuit, a converter circuit, a controller and the like. The rectifier circuit converts AC power into DC power, and the converter circuit may generate driving power using DC power. Depending on the application field of the lighting device 800, the LED driver 810 may have waterproof and dustproof performance. In an example embodiment, the LED driver 810 may be sealed with a sealing member capable of blocking penetration of moisture and dust.

In an example embodiment, the LED driver 810 may output a constant current to drive the LEDs connected to the output harness 815, and the magnitude of the constant current may be determined by the controller. The controller may provide a dimming function capable of adjusting the magnitude of the constant current output by the LED driver 810 within a rated current range. The controller may adjust the magnitude of the constant current according to the dimming control signal input through the dimming terminals DIM+ and DIM−.

Referring to FIG. 14, the LED device 820 may include LED strings 821 and a switch controller 822, and the switch controller 822 may include a power supply 823, a controller 824, a switching circuit 825, a dimming controller 826, and the like. When the controller 824 receives a control command for changing the brightness of light emitted by the LED strings 821, from an external controller, through wired or wireless communications, the controller 824 may convert the control command into a dimming control signal which is a PWM signal and may transmit the converted signal to the dimming controller 826. The dimming controller 826 may determine a dimming control voltage based on the duty ratio of the dimming control signal and may output the dimming control voltage to the dimming control terminals DIM+ and DIM−. Depending on the magnitude of the dimming control voltage received through the dimming control terminals DIM+ and DIM−, the magnitude of the constant current output by the LED driver 810 may increase or decrease.

FIG. 15 is a diagram illustrating a connection method between an LED driver 910 that does not provide a dimming function and an LED device 920. Referring to FIG. 15, the LED driver 910 may be connected to an input harness 911 and an output harness 915. The input harness 911 may include a plurality of input terminals 912-914 receiving AC power, and the output harness 915 may include a plurality of output terminals 916 and 917 for transmitting driving power generated by the LED driver, to the LEDs.

In the example embodiment illustrated in FIG. 15, the LED driver 910 does not provide a dimming function, and therefore, a separate dimming control terminal is not present in the LED driver 910. Accordingly, in the example embodiment illustrated in FIG. 15, the dimming controller 926 of the LED device 920 includes dimming control switches connected to a node between the LEDs of the LED strings 921, and may implement the dimming function in a manner of changing the number of LEDs that actually emit light by turning on or off each of the dimming control switches. As an example, the dimming function may be implemented in the same manner as described with reference to FIG. 13.

Figure 16:
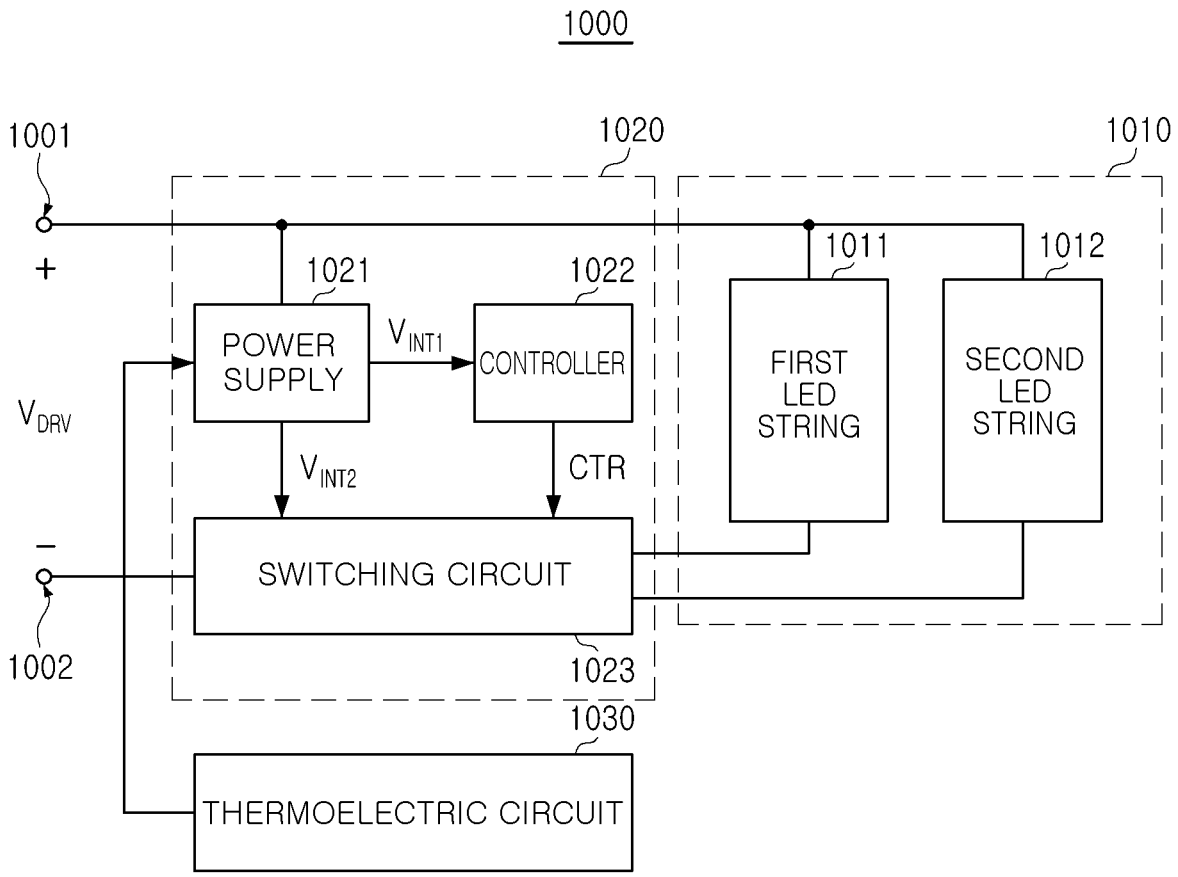
FIGS. 16 and 17 are schematic views illustrating LED devices according to example embodiments.
Figure 17:
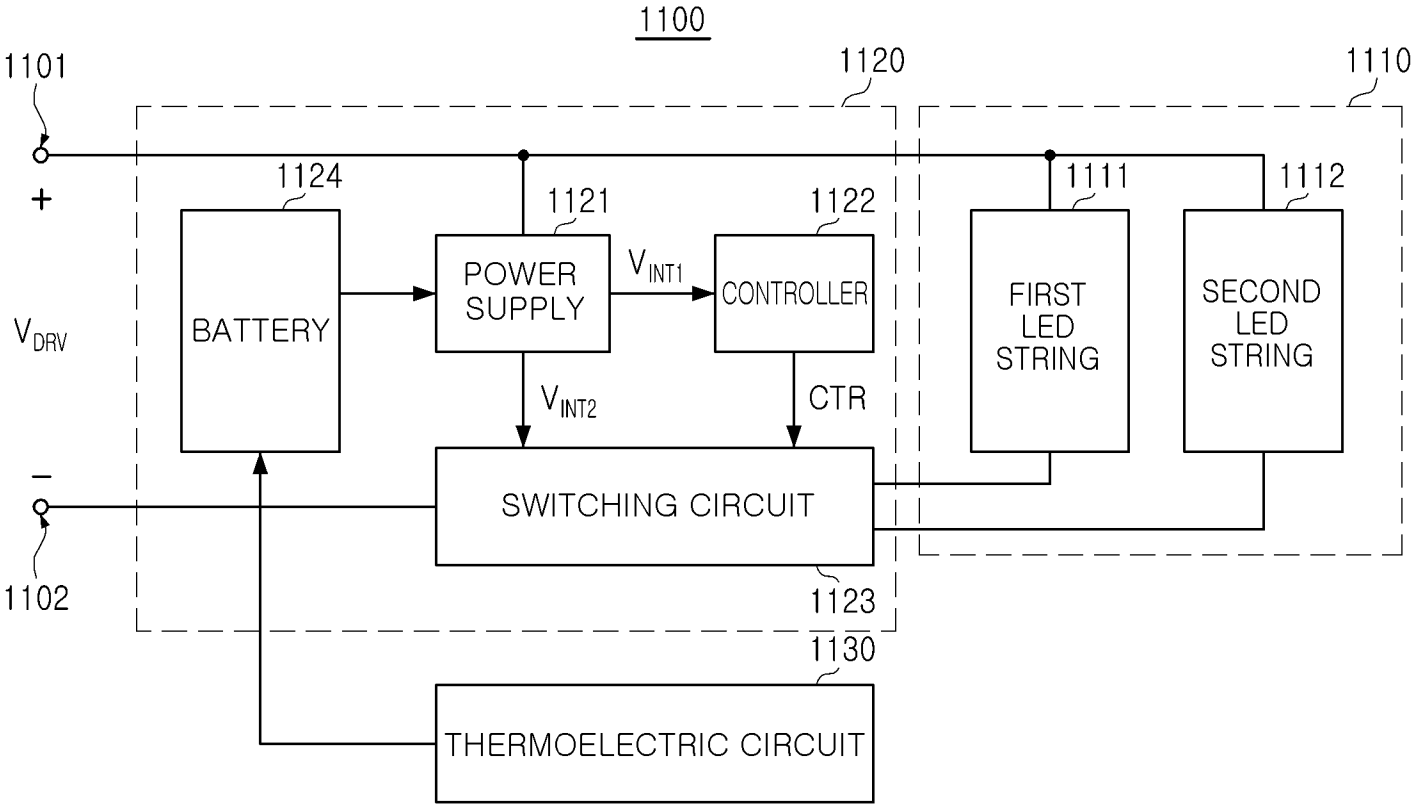

FIGS. 16 and 17 are schematic views illustrating an LED device according to example embodiments.

According to example embodiments illustrated in FIGS. 16 and 17, LED devices 1000 and 1100 may include thermoelectric circuits 1030 and 1130. The thermoelectric circuits 1030 and 1130 include a thermoelectric element for converting heat into electrical energy, respectively. Referring to FIG. 16, the LED device 1000 may include LED strings 1010, a smart controller 1020, and the thermoelectric circuit 1030. The thermoelectric circuit 1030 includes a thermoelectric element, and is attached to the LED strings 1010 to convert heat generated during operation of the LED strings 1010 into electrical energy. In an example embodiment, the thermoelectric element may be a device using a Seebeck effect in which electrical energy is generated by a temperature difference occurring between different metals or semiconductors.

Immediately after the LED strings 1010 starts to emit light in the LED device 1000, almost no heat may be generated in the LED strings 1010. Accordingly, at the initial stage of the operation of the LED device 1000, as described above, the power supply 1021 may generate the internal power voltages $V_{INT1}$ and $V_{INT2}$ using the driving power $V_{DRV}$. When the temperature of the LED strings 1010 rises after a certain period of time and electrical energy is generated in the thermoelectric circuit 1030, the electrical energy of the thermoelectric circuit 1030 may be supplied to the power supply 1021.

For example, the power supply 1021 may include a capacitor charged with electric energy supplied by the thermoelectric circuit 1030. When the capacitor is charged, internal power voltages $V_{INT1}$ and $V_{INT2}$ for the operation of the switch controller 822 and the switching circuit 825 may be generated from the capacitor. Accordingly, the controller 1022 and the switching circuit 1023 may operate based on power provided by the capacitor, and the smart controller 1020 may operate in a state in which the influence on the LED driver connected to the LED device 1000 through the driving nodes 1001 and 1002 is significantly reduced.

Next, in the example embodiment illustrated in FIG. 17, the smart controller 1120 may include a battery 1124. For example, the battery 1124 may include a lithium-ion battery, a charging circuit and the like.

When the LED device 1100 is initially driven, the battery 1124 may be in a discharged state. Accordingly, the power supply 1121 may generate the internal power voltages $V_{INT1}$ and $V_{INT2}$ using the driving power $V_{DRV}$ generated by the LED driver connected through driving nodes 1101 and 1102.

When a predetermined time elapses after the LED strings 1110 operates, the thermoelectric circuit 1130 outputs electrical energy by heat generated from the LED strings 1110, and the battery 1124 may be charged therefrom. When the charge amount of the battery 1124 exceeds a predetermined threshold value, the power supply 1121 may generate the internal power voltages $V_{INT1}$ and $V_{INT2}$, using the output power of the battery 1124, not the driving power $V_{DRV}$. Accordingly, the controller 1122 and the switching circuit 1123 may operate based on power provided by the battery 1124, and the influence of the smart controller 1120 on the LED driver connected to the LED device 1100 through the driving nodes 1101 and 1102 may be significantly reduced.

As set forth above, according to example embodiments, functions such as communication with an external controller, monitoring operation status, and adjustment of brightness and/or color temperature may be implemented, by replacing only a light source including an LED without replacing or upgrading an LED driver or the like included in an existing lighting device. Therefore, a lighting device significantly increasing user convenience while significantly reducing waste of previously installed devices may be implemented.

While example embodiments have been described above with reference to the accompanying drawings, it will be apparent to those skilled in the art that modifications and variations could be made without departing from the scope of the present disclosure.

What is claimed is:

1. A light emitting diode (LED) device comprising:

a first LED string including first LEDs emitting light having a first color temperature;

a second LED string connected to the first LED string in parallel, and including second LEDs emitting light having a second color temperature different from the first color temperature;

a smart controller including a controller configured to generate a control signal based on a control command received from an external controller, a switching circuit configured to control brightness of any one or any combination of the first LED string and the second LED string based on the control signal, a power supply configured to generate an internal power voltage for operation of the controller and the switching circuit, and a dimming controller including a switching unit and a switch control circuit, wherein each of a plurality of dimming control switches included in the switching unit is connected to a node between the first LEDs and a node between the second LEDs.

2. The LED device of claim 1, wherein the switching circuit comprises a switch connected to the second LED string in series, and a switch driver configured to control the switch based on the control signal.

3. The LED device of claim 1, wherein the switching circuit comprises a first switch connected to the first LED string in series, a second switch connected to the second LED string in series, and a switch driver configured to control the first switch and the second switch based on the control signal.

4. The LED device of claim 3, wherein the switch driver is configured to control the first switch based on a PWM signal and control the second switch based on the PWM signal.

5. The LED device of claim 3, wherein the switch driver is configured to provide a first PWM signal to the first switch, provide a second PWM signal to the second switch, and wherein a first phase of the first PWM signal is opposite to a second phase of the second PWM signal.

6. The LED device of claim 3, wherein the switch driver is configured to provide a first PWM signal to the first switch, provide a second PWM signal to the second switch, and wherein the first PWM signal is different from the second PWM signal.

7. The LED device of claim 1, wherein the controller is configured to provide information indicating states of the first LED string, and the second LED string to the external controller.

8. The LED device of claim 1, wherein the power supply comprises a first regulator configured to generate a first internal power voltage for operation of the controller, and a second regulator configured to generate a second internal power voltage for operation of the switching circuit, and wherein a first magnitude of the first internal power voltage is different from a second magnitude of the second internal power voltage.

9. The LED device of claim 8, wherein the first magnitude is lower than the second magnitude.

10. The LED device of claim 1, wherein the smart controller is provided on an individual module that is separate from the first LED string and the second LED string.

11. The LED device of claim 1, wherein the first LED string is connected between a first input node and a first output node, and the second LED string is connected between a second input node and a second output node, and wherein the first input node and the second input node are electrically connected to each other, and the first output node is isolated from the second output node.

12. The LED device of claim 1, wherein the dimming controller controls the dimming control switches according to a duty ratio of a PWM signal generated by the controller based on the control command.

13. A lighting device comprising:

an LED driver configured to generate driving power using alternating current (AC) power, and output the driving power through a first driving node and a second driving node;

a plurality of LED strings comprising a first LED string connected between the first driving node and a first LED output node, and a second LED string connected between the first driving node and a second LED output node, the first LED string, being configured to emit light having a first color temperature and the second LED string being configured to emit light having a second color temperature; and a smart controller connected to the first driving node, the second driving node, the first LED output node and the second LED output node, between the LED driver and the plurality of LED strings, wherein the smart controller comprises a switching circuit connected to the first LED output node, the second LED output node and the second driving node, and is configured to adjust brightness of any one or any combination of the first LED string and the second LED string, wherein the smart controller comprises a dimming controller including a switching unit and a switch control circuit, and each of a plurality of dimming control switches included in the switching unit is connected to a node between the first LEDs and a node between the second LEDs.

14. The lighting device of claim 13, wherein the LED driver comprises a rectifier circuit configured to rectify the AC power, and a converter circuit configured to generate the driving power using an output of the rectifier circuit.

15. The lighting device of claim 13, wherein the first LED string is configured to emit white light having the first color temperature, and the second LED string is configured to emit white light having the second color temperature, and wherein the second color temperature is higher than the first color temperature.

16. The lighting device of claim 13, further comprising a thermoelectric circuit attached to the plurality of LED strings and comprising a thermoelectric element configured to convert heat emitted from the plurality of LED strings into electrical energy.

17. The lighting device of claim 16, wherein the smart controller further comprises a power supply connected to the first driving node and an output node of the thermoelectric circuit, configured to generate an internal power voltage for at least one component of the controller using the driving power and output power of the thermoelectric circuit.

18. The lighting device of claim 16, wherein the smart controller further comprises a battery connected to an output node of the thermoelectric circuit, and a power supply configured to generate an internal power voltage using output power of the battery.

19. An LED device comprising:

a plurality of LEDs directly connected to at least a portion of a plurality of output terminals of an output harness of an LED driver;

a power supply connected to a first output terminal of the plurality of output terminals and configured to generate a first internal power voltage and a second internal power voltage using a driving power received from the LED driver via the first output terminal;

a controller configured to operate using the first internal power voltage and generate a PWM control signal based on a control command received from an external controller;

a switching circuit connected between one of the plurality of LEDs and a second output terminal of the plurality of output terminals, and configured to operate using the second internal power voltage and adjust brightness of a portion of the plurality of LEDs based on the PWM control signal;

a thermoelectric circuit configured to output electrical energy by heat generated from the plurality of LEDs; and a battery being charged by the electrical energy from the thermoelectric circuit.

* * * * *